US006596352B2

(12) United States Patent
Weder

(10) Patent No.: US 6,596,352 B2
(45) Date of Patent: Jul. 22, 2003

(54) DECORATIVE GRASS HAVING A THREE-DIMENSIONAL PATTERN AND METHODS FOR PRODUCING SAME

(75) Inventor: Donald E. Weder, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 0 days.

(21) Appl. No.: 10/058,193

(22) Filed: Jan. 25, 2002

(65) Prior Publication Data

US 2002/0064609 A1 May 30, 2002

Related U.S. Application Data

(63) Continuation of application No. 09/572,750, filed on May 16, 2000, now abandoned, which is a division of application No. 09/151,789, filed on Sep. 11, 1998, now abandoned, which is a continuation-in-part of application No. 08/967,706, filed on Nov. 10, 1997, now Pat. No. 5,839,255.

(51) Int. Cl.[7] ..... A41G 1/00

(52) U.S. Cl. ..... 428/17; 428/158; 428/153; 428/152; 428/7; 428/15; 428/195; 206/814; 206/521; 206/584

(58) Field of Search ..... 428/17, 402, 222, 428/195, 158, 153, 152, 211, 7, 15, 141; 206/814, 584, 521

(56) References Cited

U.S. PATENT DOCUMENTS

| | | | | |
|---|---|---|---|---|
| 557,526 | A | 3/1896 | Egge | |
| 732,889 | A | 7/1903 | Paver | |
| 1,525,015 | A | 2/1925 | Weeks | 53/461 |
| 1,863,216 | A | 6/1932 | Wordingham | |
| 1,978,631 | A | 10/1934 | Herrlinger | 91/68 |
| 2,032,386 | A | 3/1936 | Wood | 229/87 |
| 2,048,123 | A | 7/1936 | Howard | 229/87 |
| 2,170,147 | A | 8/1939 | Lane | 296/56 |
| 2,240,072 | A | 4/1941 | Hodgdon et al. | |

(List continued on next page.)

FOREIGN PATENT DOCUMENTS

| | | |
|---|---|---|
| DE | 1166692 | 3/1964 |
| EP | 0142867 | 5/1985 |
| GB | 1204647 | 9/1970 |
| JP | 5575466 | 6/1980 |
| JP | 6215672 | 9/1987 |
| WO | 9003412 | 4/1990 |
| WO | 9916615 | 4/1999 |

OTHER PUBLICATIONS

Brochure, "The Simple Solution For Those Peak Volume Periods" Highland Supply Corp. ©1989.

Speed Sheets & Speed Rolls Brochure, Highland Supply Corporation, ©1990, 2 Pgs. No month.

LePlant SAC Advertisement, published prior to Sep. 26, 1987.

*Primary Examiner*—Deborah Jones
*Assistant Examiner*—Wendy Boss
(74) *Attorney, Agent, or Firm*—Dunlap, Codding & Rogers, P.C.

(57) ABSTRACT

A method for making decorative grass having a three-dimensional pattern which constitutes at least a portion of the decor of the decorative grass. Printed designs or materials and/or embossed materials can also constitute a portion of the decor of the decorative grass. The method includes slitting a material having a three-dimensional pattern on at least a portion of at least one surface thereof and then cutting the slit material into segments of a predetermined length to provide the decorative grass having a three-dimensional pattern.

13 Claims, 9 Drawing Sheets

U.S. PATENT DOCUMENTS

| | | | | |
|---|---|---|---|---|
| 2,278,673 | A | 4/1942 | Savada et al. | 154/43 |
| 2,371,985 | A | 3/1945 | Freiberg | 206/46 |
| 2,411,328 | A | 11/1946 | MacNab | 33/12 |
| 2,510,120 | A | 6/1950 | Leander | 117/122 |
| 2,529,060 | A | 11/1950 | Trillich | 117/68.5 |
| 2,544,075 | A | 3/1951 | Ernst et al. | 150/49 |
| 2,621,142 | A | 12/1952 | Wetherell | 154/117 |
| 2,679,887 | A | 6/1954 | Doyle et al. | |
| 2,774,187 | A | 12/1956 | Smithers | |
| 2,822,287 | A | 2/1958 | Avery | 117/14 |
| 2,846,060 | A | 8/1958 | Yount | 206/58 |
| 2,883,262 | A | 4/1959 | Borin | 21/56 |
| 2,989,828 | A | 6/1961 | Warp | |
| 3,022,605 | A | 2/1962 | Reynolds | 47/58 |
| 3,027,263 | A | 3/1962 | Wanamaker | 99/172 |
| 3,094,810 | A | 6/1963 | Kalpin | |
| 3,113,712 | A | 12/1963 | Kindseth | 229/14 |
| 3,121,647 | A | 2/1964 | Harris et al. | 118/202 |
| 3,130,113 | A | 4/1964 | Silman | 161/97 |
| 3,148,799 | A | 9/1964 | Meroney | 220/63 |
| 3,150,031 | A | 9/1964 | Powell | |
| 3,215,330 | A | 11/1965 | Thomas | 229/14 |
| 3,231,645 | A | 1/1966 | Bolomey | |
| 3,251,728 | A | 5/1966 | Humbert et al. | 161/168 |
| 3,271,922 | A | 9/1966 | Wallerstein et al. | 53/3 |
| 3,376,666 | A | 4/1968 | Leonard | |
| 3,400,036 | A | 9/1968 | Hemrick et al. | |
| 3,431,706 | A | 3/1969 | Stuck | |
| 3,475,191 | A | 10/1969 | Lodge et al. | |
| 3,481,663 | A | 12/1969 | Greenstein | |
| 3,508,372 | A | 4/1970 | Wallerstein et al. | 53/3 |
| 3,514,012 | A | 5/1970 | Martin | 220/63 |
| 3,549,405 | A | 12/1970 | Schrenk et al. | |
| 3,554,434 | A | 1/1971 | Anderson | |
| 3,616,192 | A | 10/1971 | Sinclair | |
| 3,620,366 | A | 11/1971 | Parkinson et al. | |
| 3,681,105 | A | 8/1972 | Milutin et al. | 117/15 |
| 3,749,629 | A | 7/1973 | Andrews et al. | |
| 3,757,990 | A | 9/1973 | Buth | 220/63 |
| 3,808,024 | A | 4/1974 | Witman | 117/11 |
| 3,865,664 | A | 2/1975 | Neumann | |
| 3,922,440 | A | 11/1975 | Wegwerth et al. | |
| 3,927,821 | A | 12/1975 | Dunning | 229/14 |
| 3,950,290 | A | 4/1976 | Drury, Jr. et al. | 260/23 |
| 3,951,892 | A | 4/1976 | Drury, Jr. et al. | 260/23 |
| 3,962,503 | A | 6/1976 | Crawford | |
| 4,054,697 | A | 10/1977 | Reed et al. | 428/40 |
| 4,055,613 | A | 10/1977 | Kapral | 264/46.4 |
| 4,068,030 | A | 1/1978 | Witman | 428/159 |
| 4,162,343 | A | 7/1979 | Wilcox et al. | |
| 4,189,868 | A | 2/1980 | Tymchuck et al. | |
| 4,199,627 | A | 4/1980 | Weder et al. | |
| 4,216,620 | A | 8/1980 | Weder et al. | 47/72 |
| 4,297,811 | A | 11/1981 | Weder | 47/72 |
| 4,333,267 | A | 6/1982 | Witte | 47/84 |
| 4,379,101 | A | 4/1983 | Smith | 264/40.3 |
| 4,380,564 | A | 4/1983 | Cancio et al. | 428/167 |
| 4,385,087 | A | 5/1983 | Roberts | |
| 4,400,910 | A | 8/1983 | Koudstaal et al. | |
| 4,413,725 | A | 11/1983 | Bruno et al. | 206/45.33 |
| 4,427,731 | A | 1/1984 | Gibson | 428/159 |
| 4,471,079 | A | 9/1984 | Enami | 523/161 |
| 4,474,110 | A | 10/1984 | Rosner | |
| RE31,780 | E | 12/1984 | Cooper et al. | |
| 4,500,373 | A | 2/1985 | Kubota | 156/79 |
| 4,520,064 | A | 5/1985 | Kanzelberger | |
| 4,530,863 | A | 7/1985 | Seeger | |
| 4,546,875 | A | 10/1985 | Zweber | 206/0.82 |
| 4,684,795 | A | 8/1987 | Colgate, Jr. | 235/457 |
| 4,690,843 | A | 9/1987 | Inagaki | 428/36 |
| 4,695,503 | A | 9/1987 | Liu et al. | 428/207 |
| 4,699,820 | A | 10/1987 | Herr, Jr. et al. | |
| 4,733,521 | A | 3/1988 | Weder et al. | 53/580 |
| 4,765,464 | A | 8/1988 | Ristvedt | 206/0.82 |
| 4,786,533 | A | 11/1988 | Crass et al. | |
| 4,801,014 | A | 1/1989 | Meadows | |
| 4,844,849 | A | 7/1989 | Miller et al. | 264/46.4 |
| 4,913,858 | A | 4/1990 | Miekka et al. | 264/1.3 |
| 4,960,638 | A | 10/1990 | Mukoyoski et al. | 428/342 |
| 4,963,218 | A | 10/1990 | Rainey | |
| 5,003,915 | A | 4/1991 | D'Amato et al. | 118/46 |
| 5,008,143 | A | 4/1991 | Armanini | |
| 5,028,482 | A | 7/1991 | Jeffs | 428/323 |
| 5,088,972 | A | 2/1992 | Parker | |
| 5,089,318 | A | 2/1992 | Shetty et al. | |
| 5,111,638 | A | 5/1992 | Weder | 53/397 |
| 5,126,010 | A | 6/1992 | Kobayashi et al. | 162/135 |
| 5,134,013 | A | 7/1992 | Parker | |
| 5,147,706 | A | 9/1992 | Kingman | 428/195 |
| 5,154,765 | A | 10/1992 | Armanini | |
| 5,173,352 | A | 12/1992 | Parker | |
| 5,181,364 | A | 1/1993 | Weder | 53/397 |
| 5,186,988 | A | 2/1993 | Dixon | 383/37 |
| 5,200,253 | A | 4/1993 | Yamaguchi et al. | 428/195 |
| 5,204,160 | A | 4/1993 | Rouser | |
| 5,205,108 | A | 4/1993 | Weder et al. | 53/397 |
| 5,228,234 | A | 7/1993 | de Klerk et al. | 206/423 X |
| 5,235,782 | A | 8/1993 | Landau | |
| 5,239,775 | A | 8/1993 | Landau | 206/423 X |
| 5,245,814 | A | 9/1993 | Weder | |
| 5,246,785 | A | 9/1993 | Matano et al. | 428/542.2 |
| 5,262,222 | A | 11/1993 | Kingman | 428/195 |
| 5,267,753 | A | 12/1993 | Chock | 283/58 |
| 5,281,261 | A | 1/1994 | Lin | 106/20 |
| 5,288,160 | A | 2/1994 | Li et al. | 401/198 |
| 5,307,605 | A | 5/1994 | Straeter | 53/466 X |
| 5,320,672 | A | 6/1994 | Whalen-Shaw | 106/287 |
| 5,335,476 | A | 8/1994 | Weder | |
| 5,335,477 | A | 8/1994 | Weder | 53/399 |
| 5,347,789 | A | 9/1994 | Weder | 53/397 |
| 5,369,934 | A | 12/1994 | Weder | |
| 5,381,642 | A | 1/1995 | Weder et al. | 53/399 |
| 5,388,386 | A | 2/1995 | Weder | |
| 5,388,695 | A | 2/1995 | Gilbert | 206/423 |
| 5,403,259 | A | 4/1995 | Parker | |
| 5,408,803 | A | 4/1995 | Weder et al. | |
| 5,428,939 | A | 7/1995 | Weder et al. | |
| 5,443,670 | A | 8/1995 | Landau | 47/72 X |
| 5,448,875 | A | 9/1995 | Weder | |
| 5,456,056 | A | 10/1995 | Weder | |
| 5,465,551 | A | 11/1995 | Weder | |
| 5,467,573 | A | 11/1995 | Weder et al. | |
| D368,654 | S | 4/1996 | Santoiemmo et al. | D9/415 |
| 5,509,251 | A | 4/1996 | Weder et al. | |
| 5,526,932 | A | 6/1996 | Weder et al. | |
| 5,533,319 | A | 7/1996 | Weder | |
| 5,533,320 | A | 7/1996 | Weder | |
| 5,537,799 | A | 7/1996 | Straeter | |
| 5,537,800 | A | 7/1996 | Weder | |
| 5,573,491 | A | 11/1996 | Parker | |
| 5,585,144 | A | 12/1996 | Waitts | 427/258 |
| 5,629,068 | A | 5/1997 | Miekka et al. | |
| 5,656,008 | A | 8/1997 | Beierlorzer | |
| 5,712,020 | A | 1/1998 | Parker | |
| 5,871,432 | A | 2/1999 | Beierlorzer | |
| 5,906,569 | A | 5/1999 | Ratzel | |
| 5,921,907 | A | 7/1999 | Beierlorzer | 493/357 |
| 5,985,380 | A | 11/1999 | Weder | |

DECORATIVE GRASS HAVING A THREE-DIMENSIONAL PATTERN AND METHODS FOR PRODUCING SAME

CROSS-REFERENCE TO RELATED APPLICATIONS

This application is a continuation of U.S. Ser. No. 09/572,750, filed May 16, 2000, now abandoned, which is a divisional of U.S. Ser. No. 09/151,789, filed Sep. 11, 1998, now abandoned, which is a continuation-in-part of U.S. Ser. No. 08/967,706, filed Nov. 10, 1997, now U.S. Pat. No. 5,839,255, issued Nov. 24, 1998.

STATEMENT REGARDING FEDERALLY SPONSORED RESEARCH OR DEVELOPMENT

Not applicable.

FIELD OF THE INVENTION

The present invention relates to methods of wrapping floral groupings and flower pots with a sheet of material to provide a decorative cover for such floral groupings and flower pots, and more particularly but not by way of limitation, to methods of wrapping floral groupings and flower pots with a sheet of material having a three-dimensional pattern printed thereon. In one aspect, the present invention relates to decorative grasses having a three-dimensional pattern, design, or printed material provided thereon.

BRIEF DESCRIPTION OF THE DRAWINGS

FIG. 24 is an enlarged, fragmental perspective view of one segment of decorative grass having printed material and embossed material thereon in addition to the three-dimensional pattern disposed thereon wherein the printed material and the embossed material are in register with one another.

FIG. 25 is an enlarged, fragmental perspective view of one segment of decorative grass having printed material and embossed material thereon in addition to the three-dimensional pattern disposed thereon wherein the printed material and the embossed material are out of register with one another.

DESCRIPTION OF THE INVENTION

The present invention comprises methods of wrapping floral groupings, flower pots containing potted plants or other pot means with a sheet of material having a three-dimensional pattern to provide a decorative cover or sleeve for such floral groupings or flower pots containing potted plants. The present invention also comprises methods for producing decorative grass having a three-dimensional pattern. The methods comprise providing a sheet of material having a three-dimensional pattern and wrapping the sheet of material about a floral grouping or a flower pot to provide a decorative cover having a three-dimensional pattern; or by cutting a sheet or roll of material having a three-dimensional pattern to provide segments of decorative grass which have a predetermined width and length.

Description of FIGS. 1–9

Figure 1:
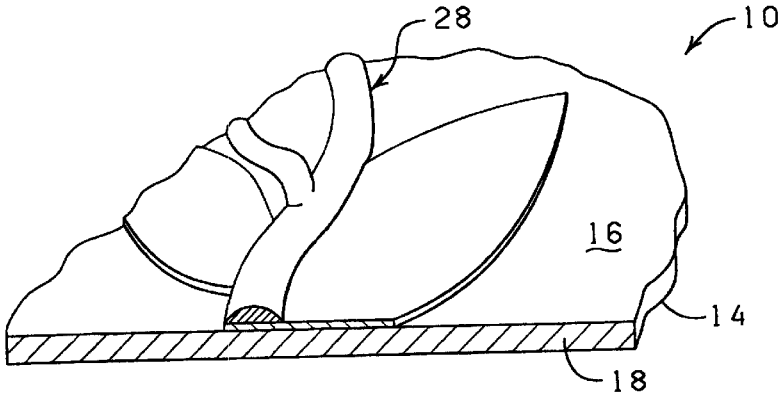
FIG. 1 is an enlarged, fragmental, perspective view of a sheet of material having a three-dimensional pattern thereon, the sheet of material used for wrapping floral groupings and flower pots and for producing decorative grass in accordance with the present invention.
Figure 2:
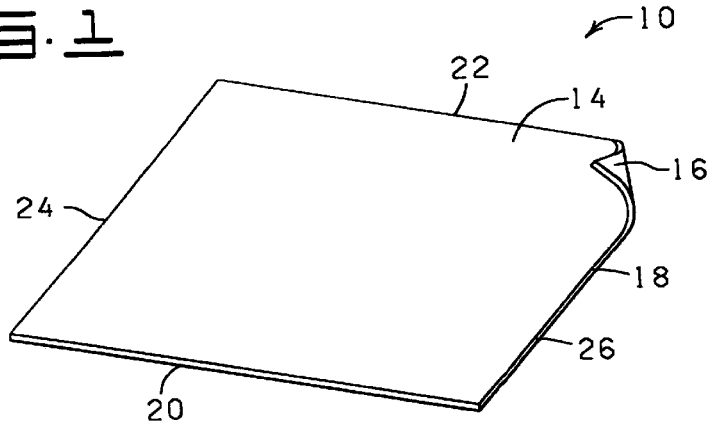
FIG. 2 is a perspective view of the sheet of material of FIG. 1.

Referring now to FIGS. 1 and 2, designated generally by the reference numeral 10 is a sheet of material having an upper surface 14, a lower surface 16, and an outer peripheral edge 18. The sheet of material 10 can be made of a polymeric material, such as polypropylene, metallized foil, paper, cloth, burlap and combinations and laminates thereof.

Figure 3:
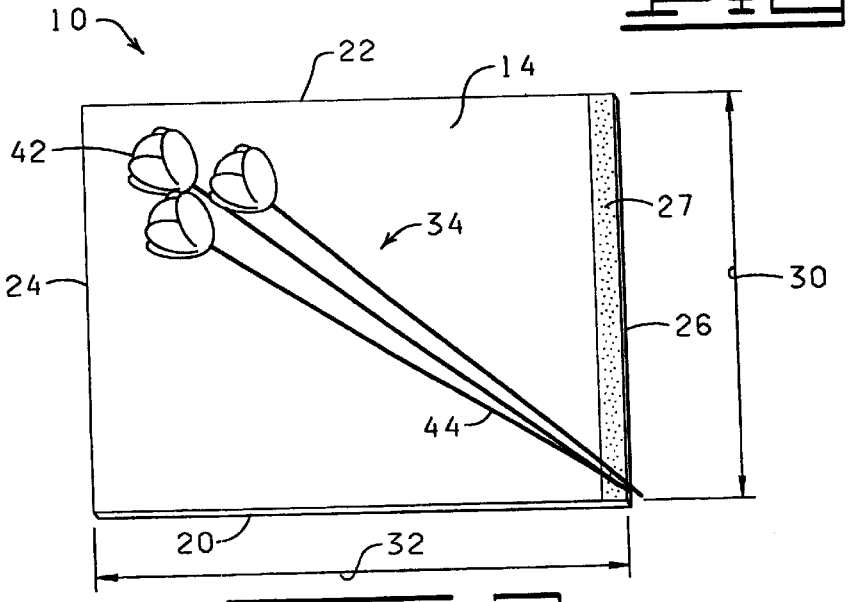
FIG. 3 is a perspective view of a sheet of material having a three-dimensional pattern disposed on a lower surface thereof and a bonding material disposed on an upper surface along one edge thereof, a floral grouping being disposed on the upper surface of the sheet of material.
Figure 4:
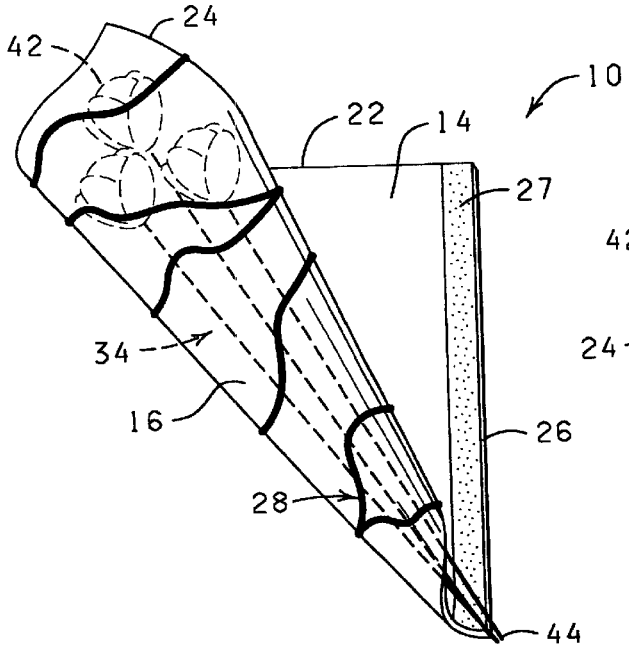
FIG. 4 is a perspective view of the floral grouping of FIG. 3 being wrapped with the sheet of material having a three-dimensional pattern on the lower surface thereof by one method of wrapping wherein the sheet of material is provided with a bonding material on the upper surface thereof.

As shown in FIG. 2, the outer peripheral edge 18 of the sheet of material 10 comprises a first side 20, a second side 22, a third side 24, and fourth side 26. A bonding material 27 (FIGS. 3 and 4) may be disposed on at least a portion of one or both surfaces of the sheet of material 10, such as the upper surface 14 thereof as shown in FIG. 3 and 4 and as further illustrated in U.S. Pat. No.

5,181,364,the specification of which is hereby expressly incorporated herein by reference.

The sheet of material 10 has a three-dimensional pattern 28 on at least a portion of one of the upper or lower surfaces 14 and 16 thereof, such as the lower surface 16 as shown in FIGS. 1 and 4–6. The three-dimensional pattern 28 may be of any geometrical shape or design which will enhance the aesthetic qualities of a decorative cover 36 or 36*a* (FIGS. 5 and 6) formed from the sheet of material 10. That is, the three-dimensional pattern 28 may be a lace pattern, curlicues, paisleys, swirls, squiggles, and any shape generally associated with botanical items such as leaves, petals, stems, roots, fruits and any other biomorphic shapes. Further, the three-dimensional pattern 28 can be produced in any suitable manner, such as by embossing or printing with a foamable ink which can be of a single color, or portions of the three-dimensional pattern 28 may be printed with foamable inks of different colors so that a portion of the three-dimensional pattern 28 is printed in at least a first color and other portions of the three-dimensional pattern 28 are printed in at least a second color such that the three-dimensional pattern 28 consists of multiple colors.

The three-dimensional pattern 28 may cover only a portion of the sheet of material 10 or may cover an entire surface of the sheet of material 10, or may cover all exposed and/or interior surfaces of the sheet of material 10. The sheet of material 10 having the three-dimensional pattern 28 may be employed to provide a decorative cover for a floral grouping (FIGS. 5 and 6) or a decorative cover for a flower pot (FIG. 8); or it may be employed to provide a sleeve for wrapping or covering a floral grouping (FIGS. 11 and 13) or a flower pot (FIGS. 15 and 16); or it may be employed to form a preformed flower pot cover for covering a flower pot (FIGS. 17 and 18); or it may be cut into segments to produce decorative grasses (FIGS. 20–25). The use of the sheet of material 10 having the three-dimensional pattern 28 to form a decorative cover for a floral grouping or a flower pot, to form a sleeve for a floral grouping or a flower pot, or to form a preformed flower pot cover or to form decorative grass will be described in more complete detail herein.

As noted above, the sheet of material 10 having the three-dimensional pattern 28 can be utilized to form a decorative cover for a floral grouping or a flower pot. The term "flower pot" as used herein refers to any type of container for holding a floral grouping, or a plant, or even another pot type container. Examples of flower pots and/or pot type containers include, but are not limited to, clay pots, wooden pots, plastic pots, pots made from natural and/or synthetic fibers, or any combination thereof. Such flower pots and or pot-type containers are provided with a retaining space for receiving a floral grouping. The floral grouping may be disposed within the retaining space of the flower pot with a suitable growing medium described in further detail below, or other retaining medium, such as a floral foam. It will also be understood that in some cases the floral grouping, and any appropriate growing medium or other retaining medium, may be disposed in a sleeve formed from the sheet of material 10 having a three-dimensional pattern 28 if the sleeve is adapted to contain a medium.

"Floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. Further, the floral grouping may comprise a growing potted plant having a root portion as well. However, it will be appreciated that the floral grouping may consist of only a single bloom or only foliage, or a botanical item (not shown), or a propagule. The term "floral grouping" may be used interchangeably herein with the term "floral arrangement". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones, or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots, or spores.

In the embodiments shown in the drawings, the sheet of material 10 having the three-dimensional pattern 28 is square. It will be appreciated, however, that the sheet of material 10 having the three-dimensional pattern 28 can be of any shape, configuration or size as long as the sheet of material 10 is sufficiently sized and shaped to wrap and encompass a flower pot or a floral grouping. For example, the sheet of material 10 may have a rectangular, round, oval, octagonal or asymmetrical shape. Further, multiple sheets of material 10 may be used in a single circumstance to provide a decorative cover or sleeve for a flower pot or a floral grouping. Moreover, when multiple sheets of material 10 are used in combination, the sheets of material 10 need not be uniform in size or shape. Finally, it will be appreciated that the sheet of material 10 having a three-dimensional pattern 28 shown in all embodiments herein is a substantially flat sheet except for the three-dimensional pattern 28 thereon.

Any thickness or stiffness of the sheet of material 10 may be utilized in accordance with the present invention as long as the sheet of material 10 having the three-dimensional pattern 28 may be wrapped about at least a portion of a flower pot or a floral grouping or cut into segments to produce decorative grass, as described herein. Stiffer sheets may be scored to facilitate their folding. The sheet of material 10 preferably has a thickness of from about 0.1 mil to about 30 mil. Typically, the sheet of material 10 has a thickness in a range of about 0.5 mil to about 2.5 mil.

The sheet of material 10 is constructed from any suitable wrapping material that is capable of being wrapped about a flower pot or floral grouping. Preferably, the sheet of material 10 is paper (untreated or treated in any manner), cellophane, metal foil, polymer film, non-polymer film, fabric (woven or nonwoven or synthetic or natural), cardboard, burlap, or laminations or combinations thereof having the three-dimensional pattern 28 thereon.

The term "polymer film" when used herein means a man-made polymer, such as a polypropylene or a naturally occurring polymer, such as cellophane. A polymer film is relatively strong and not as subject to tearing (substantially non-tearable), as might be the case with paper or foil.

The sheet of material 10 may also be constructed, in whole or in part, from a cling material. "Cling Wrap or Material" when used herein means any material which is capable of connecting to the sheet of material and/or itself upon contacting engagement during the wrapping process and is wrappable about an item, whereby portions of the cling material contactingly engage and connect to other portions of another material, or, alternatively, itself, for generally securing the material wrapped about at least a portion of a flower pot or a floral grouping. This connecting engagement is preferably temporary in that the material may be easily removed, i.e., the cling material "clings" to the flower pot or floral grouping.

The cling material is constructed, and treated if necessary, from polyethylene such as Cling Wrap made by Glad®, First Brands Corporation, Danbury, Conn. The thickness of the cling material will, in part, depend upon the size of sleeve or cover and the size of the flower pot or floral grouping in the sleeve or cover, i.e., generally, a larger flower pot may require a thicker and therefore stronger cling material. The cling material will range in thickness from about 0.1 mil to about 10 mil, and preferably from about 0.5 mil to about 2.5 mil and most preferably from about 0.6 mil to about 2 mil. However, any thickness of cling material may be utilized in accordance with the present invention which permits the cling material to be printed with a foamable ink composition so as to provide the cling material with a three-dimensional printed pattern which is capable of functioning as described herein.

In one embodiment, the sheet of material 10 may be constructed from two polypropylene films wherein at least a lower or outer surface of one of the sheets polypropylene film is provided with a three-dimensional pattern. The sheets of polypropylene film having the three-dimensional pattern employed to produce the sheet of material 10 may be connected together or laminated or may be separate layers. In an alternative embodiment, the sheet of material 10 may be constructed from only one sheet of polypropylene film having a three-dimensional pattern.

The sheet of material 10 may vary in color. Further, the sheet of material 10 may comprise other decorative patterns or designs in addition to the three-dimensional pattern 28 which are printed, etched, and/or embossed thereon. In addition, the sheet of material 10 may have various colorings, coatings, flocking and/or metallic finishes, applied separately or simultaneously, or may be characterized totally or partially by pearlescent, opaque, translucent, transparent, tinted, iridescent or the like, qualities. Each of the above-named characteristics may occur alone or in combination. Moreover, each surface of the sheet of material 10 may vary in the combination of such characteristics.

The sheet of material 10 has a width 30 extending generally between the first side 20 and the second side 22, respectively, sufficiently sized whereby the sheet of material 10 can be wrapped about and encompass a floral grouping or a flower pot. The sheet of material 10 has a length 32 extending generally between the third side 24 and the fourth side 26, respectively, sufficiently sized whereby the sheet of material 10 extends over a substantial portion of the floral grouping when the sheet of material 10 has been wrapped about the floral grouping in accordance with the present invention as described in detail herein. The sheet of material 10 may also be wrapped about a flower pot to substantially wrap and cover the flower pot or cut into segments to produce decorative grass in accordance with the present invention.

A plurality of sheets of material 10 may be connected together to form a roll as is shown in U.S. Pat. No. 5,459,976, issued Oct. 24, 1995, to Weder, et al. entitled "MATERIAL AND ADHESIVE STRIP DISPENSER", the specification of which is hereby expressly incorporated in its entirety herein by reference.

A plurality of sheets of material 10 may be connected together to form a roll as is shown in U.S. Pat. No. 5,459,976, issued Oct. 24, 1995 to Weder et al., entitled "MATERIAL AND ADHESIVE STRIP DISPENSER", the specification of which is hereby expressly incorporated in its entirety herein by reference.

The ink compositions which can be applied to the sheet of material 10 to produce the three-dimensional pattern 28 on the sheet of material 10 can be any ink composition, either solvent-based or water-based, which is compatible with the sheet of material 10 and which contains a foaming agent capable of foaming the ink composition on curing to produce the three-dimensional pattern 28. Such foamable ink compositions are well known in the printing art. However, for environmental reasons it is preferred that the foamable ink composition be a water-based ink composition. An example of a foamable water-based ink composition which can be employed to produce the three-dimensional pattern 28 on the sheet of material 10 is disclosed in U.S. Pat. No. 5,594,048 entitled "Water Based Ink Composition Free Of Volatile Organic Compounds For Disposition On A Substrate", the specification of which is hereby expressly incorporated in its entirety herein by reference.

FIGS. 3–6 illustrate the wrapping of a floral grouping 34 with the sheet of material 10 having a three-dimensional pattern 28 to provide a decorative cover 36 for the floral grouping 34. The sheet of material 10 (which may optionally have the strip of bonding material 27 disposed upon the upper surface 14, the lower surface 16 or both, such as the strip of bonding material 27 disposed along at least a portion of the upper surface 14 so as to be disposed substantially adjacent the fourth side 26 of the sheet of material 10 as shown in FIGS. 3 and 4) is provided, either as an individual sheet or from a pad or roll of material and the like.

FIGS. 3–6 illustrate the wrapping of a floral grouping 34 with the sheet of material 10 having a three-dimensional pattern 28 to provide a decorative cover 36 for the floral grouping 34. The sheet of material 10 (which may optionally have the strip of bonding material 27 disposed upon the upper surface 14, the lower surface 16 or both, such as the strip of bonding material 27 disposed along at least a portion of the upper surface 14 so as to be disposed substantially adjacent the fourth side 26 of the sheet of material 10 as shown in FIGS. 3 and 4) is provided, either as an individual sheet of material 10 or from a pad or roll of material and the like.

Figure 5:
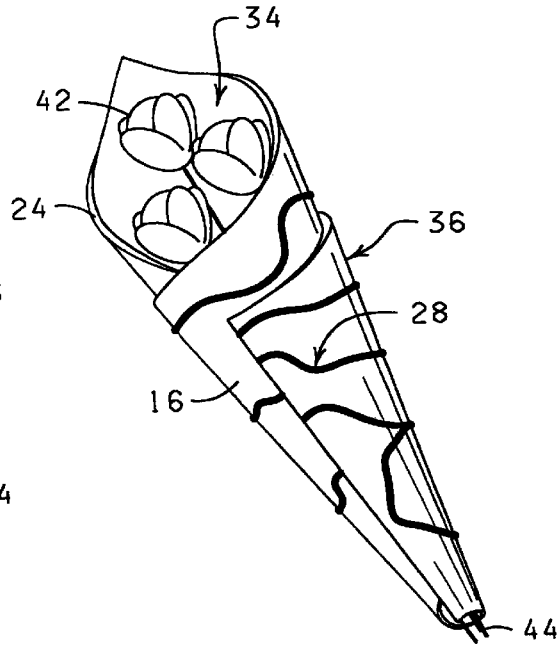
FIG. 5 is a perspective view of a decorative cover for the floral grouping formed from the sheet of material of FIG. 3 wherein the decorative cover formed from the sheet of material has a conical configuration.

Referring more specifically to FIG. 3, the floral grouping 34 is placed upon the upper surface 14 of the sheet of material 10 in a diagonal orientation. The floral grouping 34 has an upper bloom or foliage portion 42 and a lower stem portion 44. As shown in FIGS. 3–5, the sheet of material 10 is then wrapped about the floral grouping 34 by the operator, the operator overlapping a portion of the sheet of material 10 over another portion of the sheet of material 10. That is, for example, the operator places the first side 20 of the sheet of material 10 over the floral grouping 34, as shown in FIG. 4. The operator continues to roll the floral grouping 34 and the sheet of material 10 in the direction toward the second side 22 of the sheet of material 10 until the upper surface 14 near second side 22 firmly engages the lower surface 16 of the sheet of material 10 and the floral grouping 34 is substantially encompassed by the sheet of material 10. Thus, the bonding material 27 contacts both the sheet of material 10 to provide the decorative cover 36 which substantially encompasses and surrounds a substantial portion of the floral grouping 34. FIG. 5 shows the floral grouping 34 wrapped in a conical fashion with the bloom end 42 exposed near the open upper end of the decorative cover 36 and the stem end 44 exposed near the lower end of the decorative cover 36.

Referring more specifically to FIG. 3, the floral grouping 34 is placed upon the upper surface 14 of the sheet of material 10 in a diagonal orientation. The floral grouping 34 has an upper bloom or foliage portion 42 and a lower stem portion 44. As shown in FIGS. 3–5, the sheet of material 10 is then wrapped about the floral grouping 34 by the operator, the operator overlapping a portion of the sheet of material 10 over another portion of the sheet of material 10. That is, for example, the operator places the first side 20 of the sheet of material 10 over the floral grouping 34, as shown in FIG. 4. The operator continues to roll the floral grouping 34 and the sheet of material 10 in the direction toward the second side 22 of the sheet of material 10 until the upper surface 14 adjacent to the fourth side 26 firmly engages the lower surface 16 of the sheet of material 10 and the floral grouping 34 is substantially encompassed by the sheet of material 10. Thus, the bonding material 27 disposed on the upper surface 14 of the sheet of material 10 contacts the lower surface 16 of the sheet of material 10 to provide the decorative cover 36 which substantially encompasses and surrounds a substantial portion of the floral grouping 34. Figure 5 shows the floral grouping 34 wrapped in a conical fashion with the bloom end 42 exposed near an open upper end 38 of the decorative cover 36 and the stem end 44 exposed near a lower end 40 of the decorative cover 36.

Figure 6:
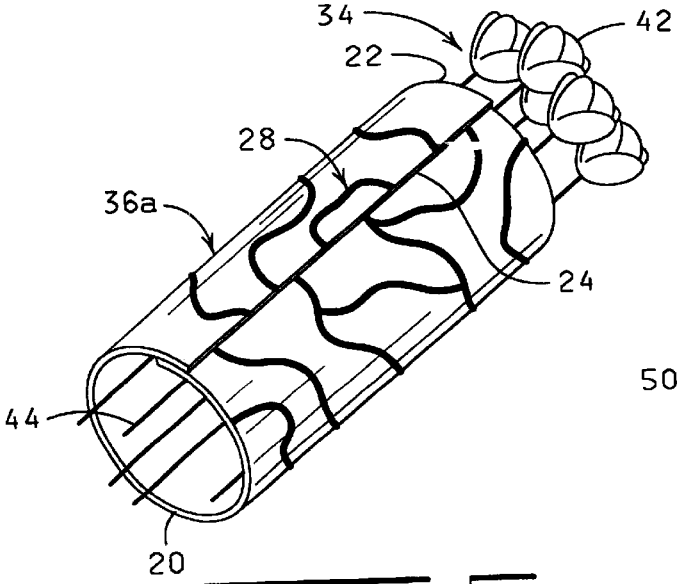
FIG. 6 is a perspective view of a decorative cover formed from a sheet of material having a three-dimensional pattern wherein the floral grouping is wrapped with the sheet of material by a second method of wrapping so that the decorative cover formed from the sheet of material has a substantially cylindrical configuration.

In another embodiment, illustrated in FIG. 6, the sheet of material 10 is utilized to wrap the floral grouping 34. The floral grouping 34 is disposed upon the sheet of material 10 approximately parallel to the fourth side 26 of the sheet of material 10. The sheet of material 10 is then wrapped generally about the stem portion 44 of the floral grouping 34 to a position wherein the fourth side 26 of the sheet of material 10 generally overlaps the third side 24 of the sheet of material 10 in a cylindrical fashion. It should be noted that the sheet of material 10 may be wrapped a plurality of times about the stem portion 44 of the floral grouping 34 before the overlapping of the third side 24 and the fourth side 26 of the sheet of material 10. As before, the portion of the sheet of material 10 near the fourth side 26 is disposed generally adjacent another portion of the sheet of material 10 and the two adjacent portions then are brought into contact where they may be bondingly engaged, thereby securing the sheet of material 10 generally about the floral grouping 34 so as to provide a decorative cover 36*a* for the floral grouping 34 wherein the decorative cover 36*a* has an open upper end 38*a* and an open lower end 40*a*.

Figure 8:
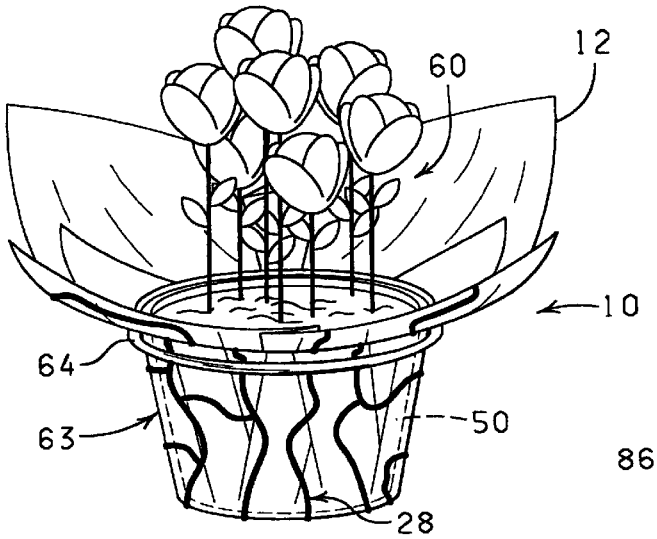
FIG. 8 is perspective view of a decorative cover positioned about the flower pot of FIG. 7 wherein the decorative cover is formed from a sheet of material having a three-dimensional pattern disposed thereon.

The sheet of material 10 may be wrapped about the flower pot 50 by any one of numerous methods used to wrap sheets of material about flower pots to form decorative pot covers for flower pots, such as a decorative cover 63 disposed about the flower pot 50 illustrated in FIG. 8. The sheet of material 10 may, for example, be formed by hand about the outer peripheral surface 56 of the flower pot 50 to produce the decorative cover 63. The decorative cover 63 can then be secured about the flower pot 50 by a bonding material or by elastic band 64 such that the open upper end 52 of the flower pot 50 remains substantially uncovered by the decorative cover 63 substantially as shown in FIG. 8.

The sheet of material 10 may be wrapped about the flower pot 50 by any one of numerous methods used to wrap sheets of material about flower pots to form decorative pot covers for flower pots, such as a decorative cover 63 disposed about the flower pot 50 illustrated in FIG. 8. The sheet of material 10 may, for example, be formed by hand about the outer peripheral surface 56 of the flower pot 50 to produce the decorative cover 63. The decorative cover 63 can then be secured about the flower pot 50 by a bonding material or by an elastic band 64 such that the open upper end 52 of the flower pot 50 remains substantially uncovered by the decorative cover 63, substantially as shown in FIG. 8.

Figure 9:
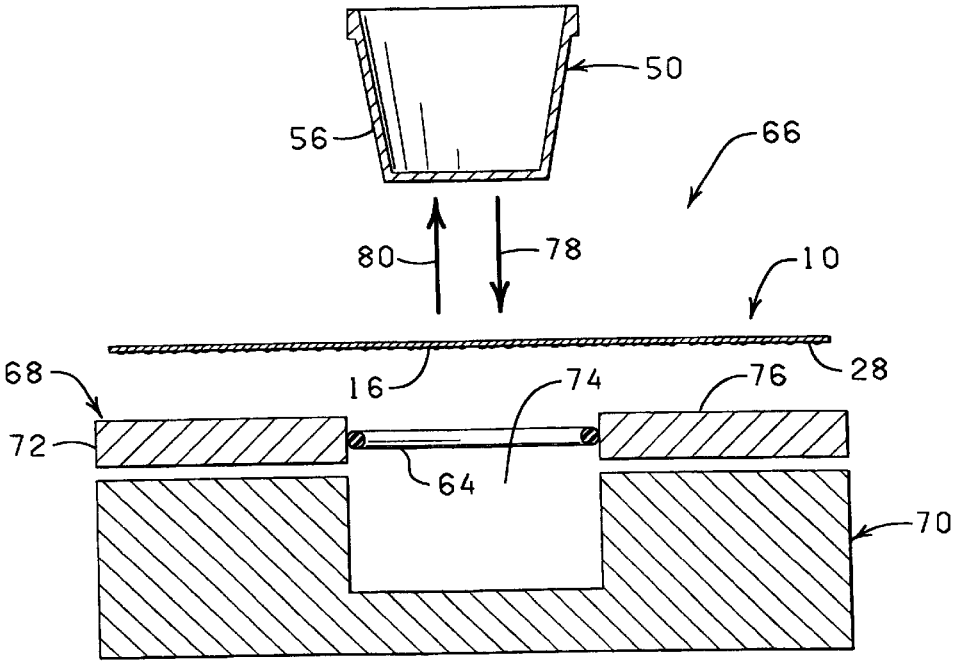
FIG. 9 is a cross-sectional view of a flower pot cover former and band applicator apparatus having the sheet of material of FIG. 2 disposed above an opening of the flower pot cover former and band applicator and having a flower pot disposed above the sheet of material.

Referring now to FIG. 9, a flower pot cover former and band applicator device 66 for forming the sheet of material 10 into the decorative cover 63 for the flower pot 50 is illustrated. The flower pot cover former and band applicator device 66 comprises a band applicator 68 and a flower pot cover former 70. The flower pot cover former and band applicator device 66 has a support platform 72 with an opening 74 formed therein. A band, such as elastic band 64, is disposed circumferentially about the opening 74 in the support platform 72.

The elastic band 64 can be applied manually or automatically about the decorative cover 63 such as by the method shown in U.S. Pat. No. 5,105,599, which is hereby expressly incorporated herein by reference. The band 64 can be applied about the decorative cover 63 as a tie using a method such as described in "Single Station Covering and Fastening System", U.S. Pat. No. 5,609,009, the specification of which is also hereby expressly incorporated herein by reference. The sheet of material 10 can also be applied automatically about the decorative cover 63, for example by methods shown in U.S. Pat. Nos. 4,733,521 and 5,291,721, both of which are hereby expressly incorporated herein by reference.

Instead of securing the decorative cover 63 about the flower pot 50 via the band 64, the decorative cover 63 formed from the sheet of material 10 may be secured to the flower pot 50 by the use of one or more bonding materials. For example, the upper surface 14 of the sheet of material 10 may have a bonding material disposed upon a portion thereof. When the sheet of material 10 is disposed about the flower pot 50, at least a portion of the upper surface 14 of the sheet of material 10 contacts the outer peripheral surface 56 of the flower pot 50 and is thereby bonded and held about the flower pot 50 via the bonding material.

The bonding material may cover a portion of the upper surface 14 of the sheet of material 10 or the bonding material may entirely cover the upper surface 14 of the sheet of material 10. The bonding material may be disposed on the upper surface 14 of the sheet of material 10 in the form of a strip or in the form of spaced-apart spots. One method for disposing a bonding material on the sheet of material 10 is described in U.S. Pat. No. 5,111,637, entitled "Method For Wrapping A Floral Grouping", issued to Weder, et al. on May 12, 1992, which is hereby expressly incorporated herein by reference.

The bonding material may cover a portion of the upper surface 14 of the sheet of material 10, or the bonding material may entirely cover the upper surface 14 of the sheet of material 10. The bonding material may be disposed on the upper surface 14 of the sheet of material 10 in the form of a strip or in the form of spaced-apart spots. One method for disposing a bonding material on the sheet of material 10 is described in U.S. Pat. No. 5,111,637, entitled "Method For Wrapping A Floral Grouping", issued to Weder et al. on May 12, 1992, which is hereby expressly incorporated herein by reference.

The term "bonding material" when used herein can mean an adhesive, frequently a pressure sensitive adhesive, or a cohesive, or any adhesive/cohesive combination having adhesive qualities (i.e., qualities of adhesion or adhesion/cohesion, respectively) sufficient to cause the attachment of a portion of the sheet of material 10 to itself, to a floral grouping, or to a flower pot. Since the bonding material may comprise an adhesive and/or a cohesive, it will be appreciated that both adhesives and cohesives are known in the art, and both are commercially available. When the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer or hot melt material which may be applied to the material and, in this instance, heat, sound waves, or vibrations, also must be applied to effect the sealing.

The term "bonding material" when used herein also means any type of material or thing which can be used to effect the bonding or connecting of the two adjacent portions of the material or sheet of material to effect the connection or bonding described herein. The term "bonding material" may also include ties, labels, bands, ribbons, strings, tapes (including single or double-sided adhesive tapes), staples or combinations thereof. Some of the bonding materials would secure the ends of the material, while other bonding materials may bind the circumference of a wrapper, or a sleeve, or, alternatively and/or in addition, the bonding materials would secure overlapping folds in the material and/or sleeve. Another way to secure the wrapping and/or sleeve is to heat seal the ends of the material to another portion of the material. One way to do this is to contact the ends with an iron of sufficient heat to heat seal the material.

Alternatively, a cold seal adhesive may be utilized as the bonding material. The cold seal adhesive adheres only to a similar substrate, acting similarly as a cohesive, and binds only to itself. The cold seal adhesive, since it bonds only to a similar substrate, does not cause a residue to build up on equipment, thereby both permitting much more rapid disposition and use of such equipment to form articles and reducing labor costs. Further, since no heat is required to effect the seal, the dwell time, that is, the time for the sheet of material to form and retain the shape of an article, such as a flower pot cover or flower pot, is reduced. A cold seal adhesive binds quickly and easily with minimal pressure, and such a seal is not readily releasable. This characteristic is different from, for example, a pressure sensitive adhesive.

The term "bonding material" when used herein also means any heat or chemically shrinkable material, and static electrical or other electrical material, chemical welding material, magnetic material, mechanical or barb-type fastening material or clamps, curl-type characteristics of the film or materials incorporated in material which can cause the material to take on certain shapes, cling films, slots, grooves, shrinkable materials and bands, curl materials, springs, and any type of welding method which may weld portions of the material to itself or to the pot, or to both the material itself and the pot.

Description of FIGS. 10–16

Figure 10:
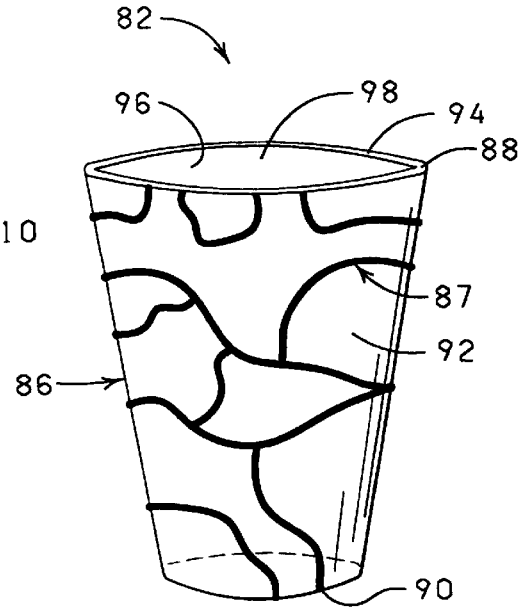
FIG. 10 is a perspective view of a floral sleeve formed from a sheet of material having a three-dimensional pattern disposed thereon.

Shown in FIG. 10 is a decorative cover designated therein by the general reference numeral 82 which comprises a flexible bag or sleeve 86 of unitary construction having a three-dimensional pattern 87 thereon in accordance with the present invention. The sleeve 86 may be used as the decorative cover 82 for a floral grouping or flower pot. The sleeve 86 initially comprises a flexible flat collapsed piece of material which is openable in the form of a tube or sleeve. Such sleeves are well know in the floral industry. Further, in accordance with the present invention, the sleeve 86 has a three-dimensional pattern 87, as previously described herein, on at least a portion thereof. The sleeve 86 has an upper end 88, a lower end 90 and an outer peripheral surface 92. The sleeve 86 may be tapered outwardly from the lower end 90 toward a larger diameter at its upper end 88. In its flattened state the sleeve 86 generally has an overall trapezoidal or modified trapezoidal shape, and when opened is substantially frusto-conical to coniform. It will be appreciated, however, that the sleeve 86 may comprise variations on the aforementioned shapes or may comprise significantly altered shapes such as square or rectangular, wherein the sleeve 86 when opened has a cylindrical form, as long as the sleeve 86 functions in accordance with the present invention in the manner described herein. The sleeve 86 (or any other sleeve disclosed herein) may have an angular or contoured shape.

The sleeve 86 has an opening 94 at the upper end 88 and may be open at the lower end 90, or closed with a bottom at the lower end 90. The sleeve 86 also has an inner peripheral surface 96 which, when the sleeve 86 is opened, defines and encompasses an inner retaining space 98. When the lower end 90 of the sleeve 86 has a closed lower end 90, a portion of the lower end 90 may be inwardly folded to form one or more gussets (not shown) for allowing the lower portion of the inner retaining space 98 to be expandable, for example, for receiving the circular bottom of a pot or growing medium.

The sleeve 86 has an opening 94 at the upper end 88 and may be open at the lower end 90, or closed with a bottom at the lower end 90. The sleeve 86 also has an inner peripheral surface 96 which, when the sleeve 86 is opened, defines and encompasses an inner retaining space 98. When the lower end 90 of the sleeve 86 is closed, a portion of the lower end 90 may be inwardly folded to form one or more gussets (not shown) for allowing the lower portion of the inner retaining space 98 to be expandable, for example, for receiving the circular bottom of a pot or growing medium.

The sleeve 86 is generally frusto-conically shaped, but the sleeve 86 may be, by way of example but not by way of limitation, cylindrical, frusto-conical, a combination of both frusto-conical and cylindrical, or any other shape, as long as the sleeve 86 functions as described herein as noted above. Further, the sleeve 86 may comprise any shape, whether geometric, non-geometric, asymmetrical and/or fanciful, as long as it functions in accordance with the present invention. The sleeve 86 may also be equipped with drain holes (if having a closed bottom) or side ventilation holes (not shown), or can be made from gas permeable or impermeable materials.

Figure 11:
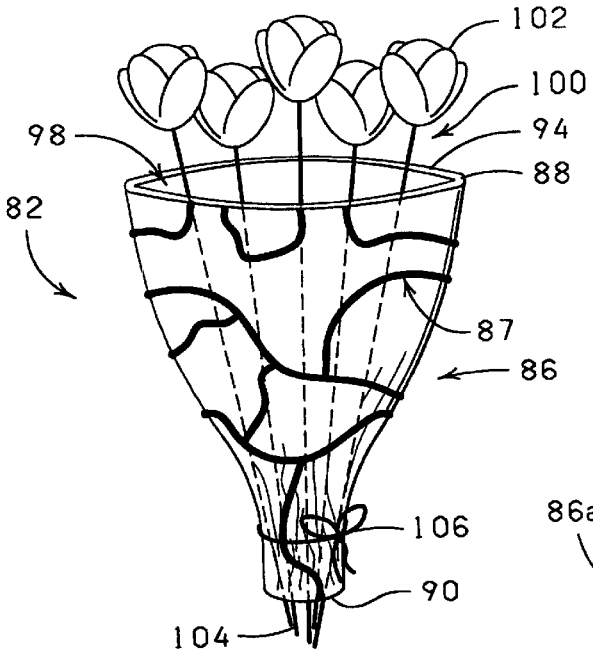
FIG. 11 is a perspective view of the floral sleeve of FIG. 10 disposed about a floral grouping.

In FIG. 11 the sleeve 86 is illustrated having the three-dimensional pattern 87 provided on the outer peripheral surface 92 of the sleeve 86. A floral grouping 100 is disposed within the inner retaining space 98 of the sleeve 86. Generally, an upper or bloom portion 102 of the floral grouping 100 is exposed near the opening 94 of the sleeve 86 and a lower or stem portion 104 of the floral grouping 100 is exposed near the lower end 90 of the sleeve 86. Either end of the sleeve 86 may be closed about the floral grouping 100. Generally, a portion of the sleeve 86 is tightened about a portion of the stem portion 104 of the floral grouping 100 for holding the decorative cover 82 about the floral grouping 100. For example, the sleeve 86 may be held by a tie 106 tied about the sleeve 86 such as is shown in FIG. 11. Other methods for binding the sleeve 86 may be employed such as the bonding materials described elsewhere herein.

In FIG. 11 the sleeve 86 is illustrated having the three-dimensional pattern 87 provided on the outer peripheral surface 92 of the sleeve 86. A floral grouping 100 is disposed within the inner retaining space 98 of the sleeve 86. Generally, an upper or bloom portion 102 of the floral grouping 100 is exposed near the opening 94 of the sleeve 86, and a lower or stem portion 104 of the floral grouping 100 is exposed near the lower end 90 of the sleeve 86. Either end of the sleeve 86 may be closed about the floral grouping 100. Generally, a portion of the sleeve 86 is tightened about a portion of the stem portion 104 of the floral grouping 100 for holding the decorative cover 82 about the floral grouping 100. For example, the sleeve 86 may be held by a tie 106 tied about the sleeve 86, such as is shown in FIG. 11. Other methods for binding the sleeve 86 may be employed, such as the bonding materials described elsewhere herein.

Similarly, it generally may be desired to use the sleeve 86 as a decorative cover for a flower pot (not shown). The flower pot will generally contain a botanical item or plant. The flower pot can be deposited into the open sleeve 86 in a manner well known in the art, such as manually, wherein the sleeve 86 is opened by hand and the flower pot deposited therein.

It will be understood that the bonding material, if present, may be disposed as a strip or block on a surface of the sleeve 86. The bonding material may also be disposed upon either the outer peripheral surface 92 or the inner peripheral surface 96 of the sleeve 86, as well as upon the flower pot. Further, the bonding material may be disposed as spots of bonding material, or in any other geometric, non-geometric, asymmetric, or fanciful form, and in any pattern including covering either the entire inner peripheral surface 96 and/or outer peripheral surface 92 of the sleeve 86 and/or the flower pot. The bonding material may be covered by a cover or release strip which can be removed prior to the use of the sleeve 86 or flower pot. The bonding material can be applied by means known to those of ordinary skill in their art. One method for disposing a bonding material on a surface of the sleeve 86, in this case an adhesive, is described in U.S. Pat. No. 5,111,637, which is hereby expressly incorporated herein by reference.

It will be understood that the bonding material, if present, may be disposed as a strip or block on a surface of the sleeve 86. The bonding material may also be disposed upon either the outer peripheral surface 92 or the inner peripheral surface 96 of the sleeve 86, as well as upon the flower pot. Further, the bonding material may be disposed as spots of bonding material, or in any other geometric, non-geometric, asymmetric, or fanciful form, and in any pattern, including covering either the entire inner peripheral surface 96 and/or outer peripheral surface 92 of the sleeve 86 and/or the flower pot. The bonding material may be covered by a cover or release strip which can be removed prior to the use of the sleeve 86 or flower pot. The bonding material can be applied by methods known to those of ordinary skill in their art. One method for disposing a bonding material on a surface of the sleeve 86, in this case an adhesive, is described in U.S. Pat. No. 5,111,637, which is hereby expressly incorporated herein by reference.

As noted above, a bonding material may be disposed on at least a portion of the inner peripheral surface 96 of the sleeve 86 (or any other sleeve described herein), or, alternatively, the bonding material may be disposed on an outer peripheral surface of a flower pot contained within the sleeve 86, while the sleeve 86 may be free of the bonding material. In a further alternative, the bonding material may be disposed both on at least a portion of the flower pot as well as upon at least a portion of the inner peripheral surface 96 of the sleeve 86. In addition, a portion of the bonding material may also be disposed on the outer peripheral surface 92 of the sleeve 86 as well. It will be understood that the bonding material may be disposed in a solid section of bonding material. The bonding material, when present, is disposed on the sleeve 86 and/or flower pot by any method known in the art.

Figure 12:
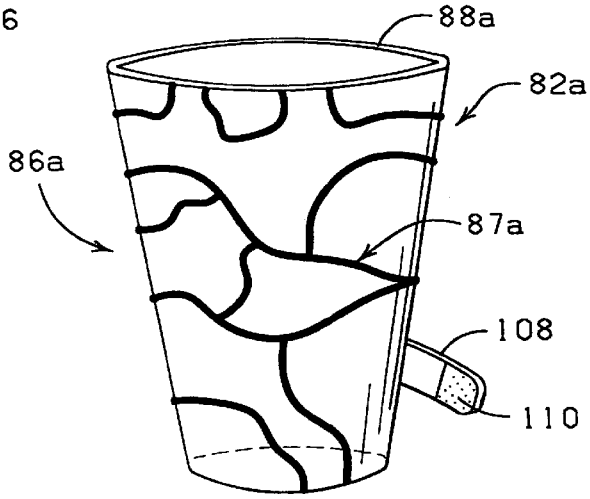
FIG. 12 is a perspective view of a floral sleeve having a cinching member wherein the floral sleeve is formed from a sheet of material having a three-dimensional pattern disposed thereon.
Figure 13:
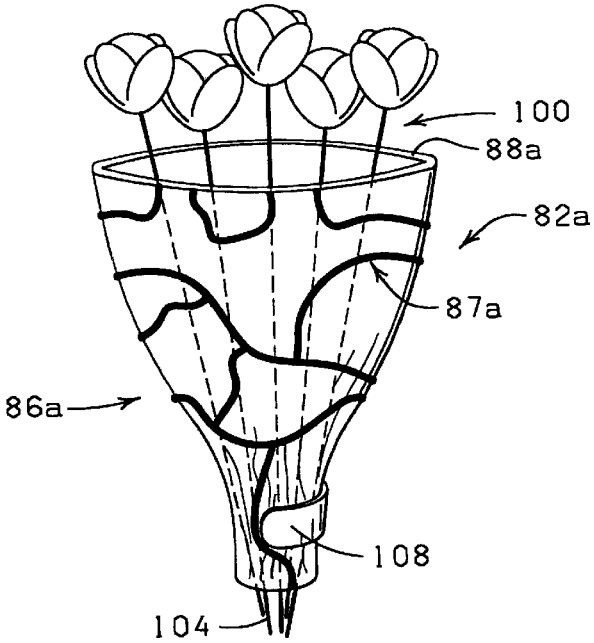
FIG. 13 is a perspective view of the floral sleeve of FIG. 12 disposed about a floral grouping.

Shown in FIGS. 12 and 13 is a decorative cover 82*a* comprising a sleeve 86*a* having a three-dimensional pattern 87*a* which is provided with a cinching tab 108 having a bonding material 110 disposed upon a surface thereof. The cinching tab 108 can be used to gather portions of the sleeve 86*a* together about the stem portion 104 of the floral grouping 100 as shown in FIG. 13 for holding the sleeve 86*a* tightly about the floral grouping 100.

Shown in FIGS. 12 and 13 is a decorative cover 82*a* comprising a sleeve 86*a* having a three-dimensional pattern 87*a* disposed thereon, the decorative cover 82*a* being provided with a cinching tab 108 having a bonding material 110 disposed upon a surface thereof. The cinching tab 108 can be used to gather portions of the sleeve 86*a* together about the stem portion 104 of the floral grouping 100 as shown in FIG. 13 for holding the sleeve 86*a* tightly about the floral grouping 100.

Figure 14:
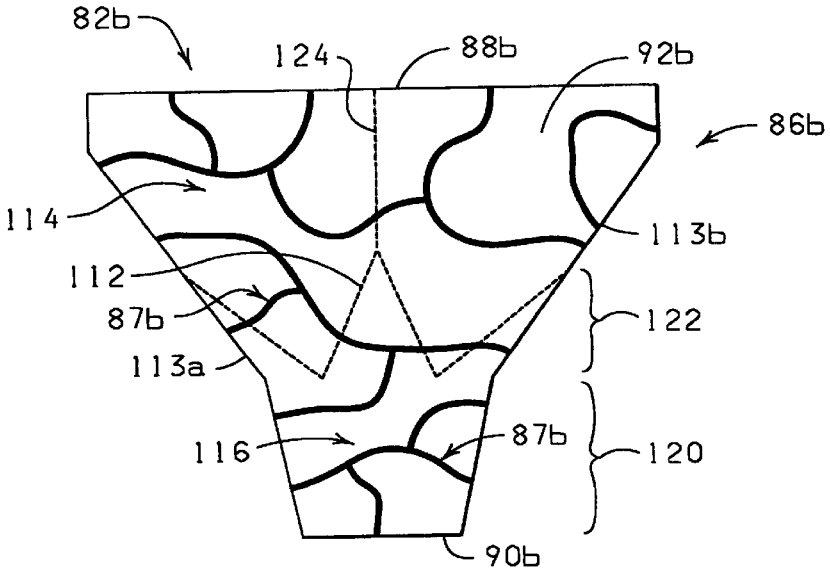
FIG. 14 is a side view of a sleeve having a detachable portion wherein the sleeve is formed from a sheet of material having a three-dimensional pattern disposed thereon.
Figure 15:
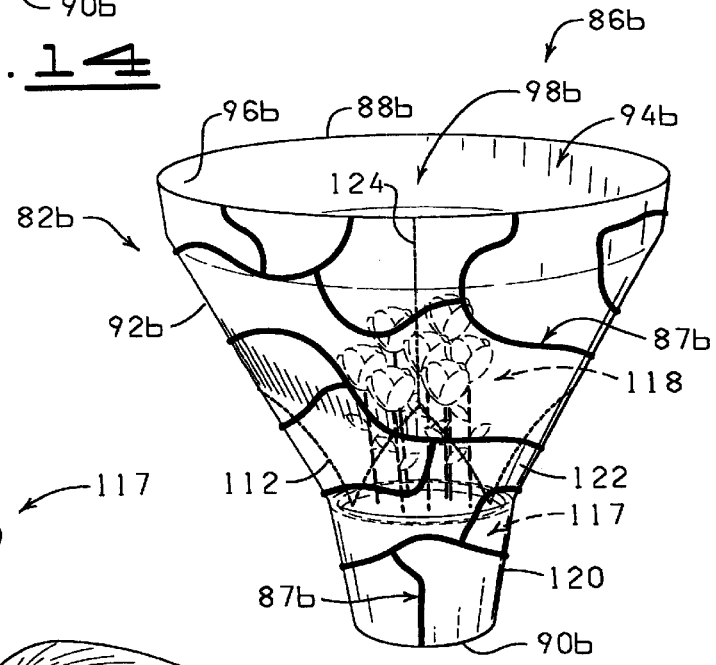
FIG. 15 is a perspective view of the sleeve of FIG. 14 having a flower pot disposed therein.

Shown in FIGS. 14 and 15 is another embodiment of a decorative cover 82*b* comprising a flexible bag or sleeve 86*b* constructed in accordance with the present invention and designated by the general reference numeral 86*b*. The sleeve 86*b* has a three-dimensional pattern 87*b* disposed thereon; and the sleeve 86*b* has a "detaching" element 112 in predetermined areas for detaching a portion of the sleeve 86*b*. The sleeve 86*b* generally initially comprises a flexible flat collapsed piece of material which is openable in the form of a tube or sleeve. The sleeve 86*b* is constructed of the same material and in the same way as described previously herein for the sleeve 86 and may be described exactly the same as the other sleeves described herein except for the additional elements described herein.

The sleeve 86*b* has an upper end 88*b*, a lower end 90*b*, and an outer peripheral surface 92*b*. The sleeve 86*b* has an opening 94*b* at the upper end 88*b* thereof, and the sleeve 86*b* may be open at the lower end 90*b* or closed with a bottom at the lower end 90*b*. In a flattened state, the sleeve 86*b* has a first side 113*a* and a second side 113*b*. The sleeve 86*b* also has an inner peripheral surface 96*b* which, when the sleeve 86*b* is opened, defines and encompasses an inner retaining space 98*b* as shown in FIG. 15. When the lower end 90*b* of the sleeve 86*b* has a closed bottom, a portion of the lower end 90*b* may be inwardly folded to form one or more gussets (not shown) for permitting a circular bottom of an object such as a flower pot 117 to be disposed in the inner retaining space 98*b* of the lower end 90*b* of the sleeve 86*b*.

As shown in FIGS. 14 and 15, the sleeve 86*b* is demarcated into an upper portion 114 and a lower portion 116. The lower portion 116 of the sleeve 86*b* is generally sized to contain the flower pot 117. The upper portion 114 of the sleeve 86*b* is sized to substantially surround and encompass a plant 118 contained in the flower pot 117 (FIGS. 15 and 16) disposed within the lower portion 116 of the sleeve 86*b*. The sleeve 86*b* is demarcated into the upper portion 114 and the lower portion 116 by the detaching element 112 which enables the detachment of the upper portion 114 of the sleeve 86*b* from the lower portion 116 of the sleeve 86*b*. In the present version, the detaching element 112 is a plurality of generally laterally-oriented or alternating diagonally-oriented perforations which extend circumferentially across the outer peripheral surface 92*b* of the sleeve 86*b* from the first side 113*a* to the second side 113*b*.

In the embodiment shown in FIGS. 14 and 15, the lower portion 116 of the sleeve 86*b* further comprises a base portion 120 and a skirt portion 122. The base portion 120 comprises that part of the lower portion 116 of the sleeve 86*b* which, when the flower pot 117 is placed into the lower portion 116 of the sleeve 86*b*, has an inner peripheral surface 96*b* which is substantially adjacent to and surrounds the outer peripheral surface of the flower pot 117. The skirt portion 122 comprises that part of the lower portion 116 of the sleeve 86*b* which extends beyond an open upper end of the flower pot 117 and is substantially adjacent at least a portion of the plant 118 contained within the flower pot 117 and which is left to freely extend at an angle, inwardly or outwardly, from the base portion 120 when the upper portion 114 of the sleeve 86*b* is detached from the lower portion 116 of the sleeve 86*b* by actuation of the detaching element 112.

Figure 16:
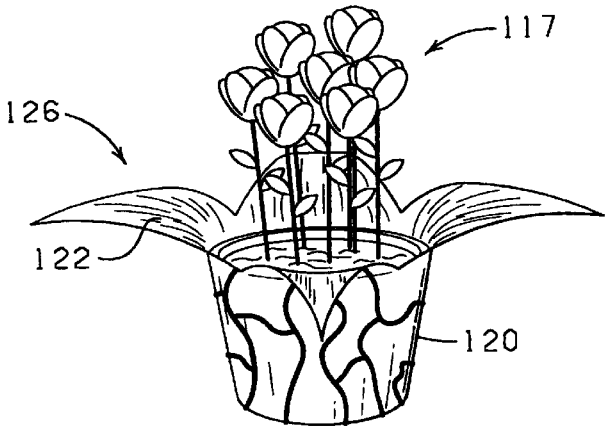
FIG. 16 is a perspective view of a flower pot disposed in the sleeve of FIG. 14 wherein an upper portion of the sleeve has been removed to provide a decorative cover having a skirt portion.

The upper portion 114 of the sleeve 86*b* is thereby separable from the lower portion 116 of the sleeve 86*b* by tearing the upper portion 114 along both the detaching element 124 and the detaching element 112, thereby separating the upper portion 114 from the lower portion 116 of the sleeve 86*b*. The lower portion 116 of the sleeve 86*b* remains disposed as the base portion 120 about the flower pot 117 and as the skirt portion 122 about the plant 118 forming a decorative cover 126 as shown in FIG. 16 which substantially surrounds and encompasses the flower pot 117 and the plant 118 contained therein. The three-dimensional pattern 87*b* may be provided on only the lower portion 116 of the sleeve 86*b*, for example, the base and skirt portions 120 and 122 while the upper portion 114 is left unprinted or is printed with another design. When the upper portion 114 is detached from the lower portion 116 of the sleeve 86*b*, the cover portion 116 containing the three-dimensional pattern 87*b* is left.

The upper portion 114 of the sleeve 86*b* is thereby separable from the lower portion 116 of the sleeve 86*b* by tearing the upper portion 114 along both the detaching element 124 and the detaching element 112, thereby separating the upper portion 114 from the lower portion 116 of the sleeve 86*b*. The lower portion 116 of the sleeve 86*b* remains disposed as the base portion 120 about the flower pot 117 and as the skirt portion 122 about the plant 118 contained in the flower pot 117, thereby forming a decorative cover 126 as shown in Figure 16, which substantially surrounds and encompasses the flower pot 117 and the plant 118 contained therein. The three-dimensional pattern 87*b* may be provided on only the lower portion 116 of the sleeve 86*b*, for example, the base and skirt portions 120 and 122, while the upper portion 114 is left unprinted or is printed with another design. When the upper portion 114 is detached from the lower portion 116 of the sleeve 86*b*, the lower portion 116 containing the three-dimensional pattern 87*b* is left.

In a general method of use of sleeves 86–86*b* as a decorative cover for a flower pot, an operator provides a sleeve 86–86*b*, and the flower pot 117 having the plant 118 disposed in a growing medium contained within the flower pot 117. The operator then disposes the flower pot 117 having the plant 118 contained therein into the sleeve 86–86*b* by opening the sleeve 86–86*b* at its upper end 88–88*b* and assuring both that the opening therein is in an open condition, and that the inner peripheral surface of the sleeve 86–86*b* is somewhat expanded outward as well, as shown in FIG. 15. The operator then manually or automatically disposes the flower pot 117 into the opening in the sleeve, the flower pot 117 being disposed generally through the upper portion of the sleeve 86–86*b* into generally the lower portion of the sleeve 86–86*b*, the flower pot 117 remaining in the lower portion of the sleeve 86–86*b*, permitting the sleeve 86–86*b* to substantially surround and tightly encompass the flower pot 117. It will be understood that, alternatively, the sleeve 86–86*b* with an extension (not shown) so that the sleeve 86–86*b* may be disposed on rods, or wickets whereby the flower pot 117 then being disposed in the sleeve 86–86*b* either before or after the sleeve 86–86*b* has been removed from the wickets.

In a general method of use of the sleeve 86*b* as a decorative cover for a flower pot, an operator provides the sleeve 86*b*, and the flower pot 117 having the plant 118 disposed in a growing medium contained within the flower pot 117. The operator then disposes the flower pot 117 having the plant 118 contained therein into the sleeve 86*b* by opening the sleeve 86*b* at its upper end 88*b* and assuring both that the opening 94*b* therein is in an open condition, and that the inner peripheral surface 96*b* of the sleeve 86*b* is somewhat expanded outward as well, as shown in FIG. 15. The operator then manually or automatically disposes the flower pot 117 into the opening 94*b* in the sleeve 86*b*, the flower pot 117 being disposed generally through the upper portion 114 of the sleeve 86*b* into generally the lower portion 116 of the sleeve 86*b*, the flower pot 117 remaining in the lower portion 116 of the sleeve 86*b*, permitting the sleeve 86*b* to substantially surround and tightly encompass the flower pot 117. It will be understood that, alternatively, the sleeve 86*b* may be provided with an extension (not shown) so that the sleeve 86*b* may be disposed on rods or wickets, whereby the flower pot 117 may then be disposed in the sleeve 86*b* either before or after the sleeve 86*b* has been removed from the wickets.

Figure 17:
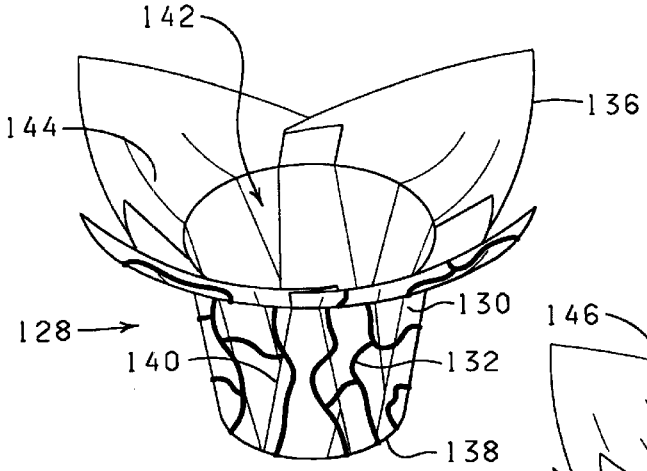
FIG. 17 is a perspective view of a preformed pot cover formed from a sheet of material having a three-dimensional pattern thereon.
Figure 18:
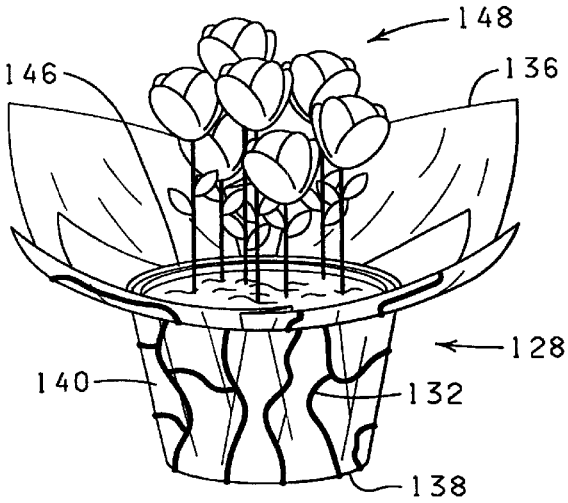
FIG. 18 is a perspective view of the preformed pot cover of FIG. 17 having a flower pot disposed therein.

Referring now to FIGS. 17 and 18, a decorative preformed flower pot cover 128 is illustrated constructed from a sheet of material 130 having a three-dimensional pattern 132 on at least one surface thereof such as a lower surface 134. The sheet of material 130 used in the construction of the preformed flower pot cover 128 is identical to the sheet of material 10 having the three-dimensional pattern 28 thereon hereinbefore described with reference to FIG. 1.

Referring now to FIGS. 17 and 18, a decorative preformed flower pot cover 128 is illustrated constructed from a sheet of material 130 having a three-dimensional pattern 132 on at least one surface thereof, such as a lower surface 134. The sheet of material 130 used in the construction of the decorative preformed flower pot cover 128 is identical to the sheet of material 10 having the three-dimensional pattern 28 thereon hereinbefore described with reference to FIG. 1.

Figure 19:
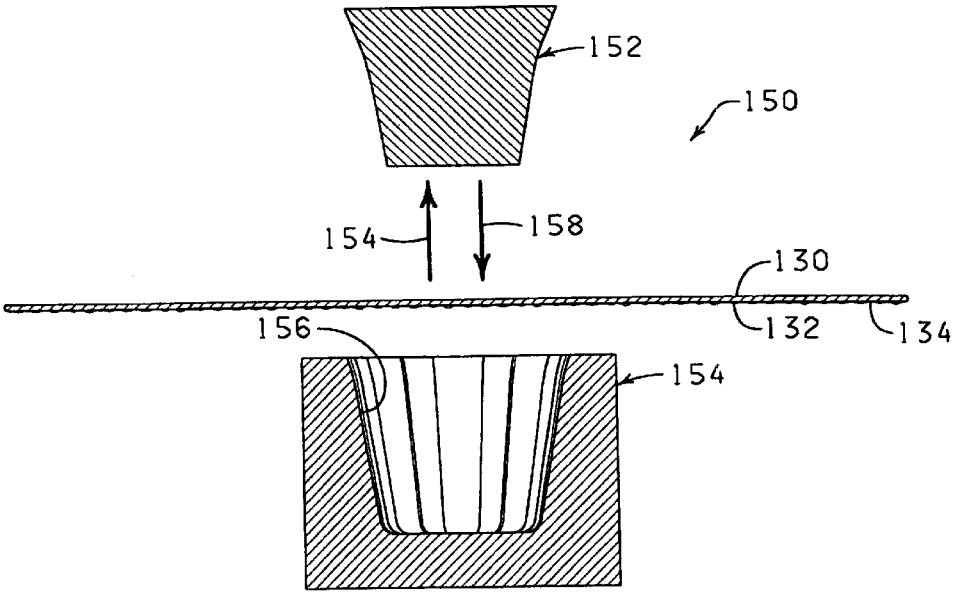
FIG. 19 is a diagrammatic, cross-sectional view of a male and female mold having a sheet of material disposed therebetween for forming the preformed pot cover of FIG. 18.

The decorative preformed flower pot cover 128 may be constructed of one sheet of material 130 having the three-dimensional pattern 132 substantially as shown in FIG. 19, or a plurality of sheets of the same and/or different types of material may be employed in the formation of the decorative preformed flower pot cover 128. The thickness of the sheet of material 130 may vary widely and any thickness of the sheet of material 130 may be utilized in accordance with the present invention as long as the sheet of material 130 is formable into the decorative preformed flower pot cover 128 as described herein. When the sheet of material 130 is constructed of a plurality of sheets of material, each sheet of material may be connected to an adjacent sheet of material via a bonding material.

The decorative preformed flower pot cover 128 may be constructed of one sheet of material 130 having the three-dimensional pattern 132 substantially as shown in FIG. 19, or a plurality of sheets of the same and/or different types of material may be employed in the formation of the decorative preformed flower pot cover 128. The thickness of the sheet of material 130 may vary widely, and any thickness of the sheet of material 130 may be utilized in accordance with the present invention as long as the sheet of material 130 is formable into the decorative preformed flower pot cover 128 as described herein. When the sheet of material 130 is constructed of a plurality of sheets of material, each sheet of material may be connected to an adjacent sheet of material via a bonding material.

The decorative preformed flower pot cover 128 may be formed using a conventional mold system 150 (FIG. 19) comprising a male mold 152 and a female mold 154 having a mold cavity 156 for matingly receiving the male mold 152. The sheet of material 130 having the three-dimensional pattern 132 thereon is positioned between the male and female molds 152 and 154, respectively. Movement of the male mold 152 in a direction 158 and into the mold cavity 156 forces the sheet of material 130 to be formed about the portion of the male mold 152 disposed in the mold cavity 156 of the female mold 154 so that, upon removal of the male mold 152 from mating engagement with the female mold 154 by movement of the male mold 152 in a direction 159, the decorative preformed pot cover 128 is recovered (substantially as shown in FIG. 17) and thereby forms the sheet of material 130 into the preformed decorative flower pot cover 128 (FIG. 18).

Further, in accordance with the present invention, the preformed flower pot cover 128 may have a bonding material disposed upon a portion thereof, and may contain printed material or designs, and/or embossed material on at least a portion thereof in addition to the three-dimensional pattern described in detail above.

Further, in accordance with the present invention, the preformed flower pot cover 128 may have a bonding material disposed upon a portion thereof, and may contain printed material or designs and/or embossed material on at least a portion thereof in addition to the three-dimensional pattern described in detail above.

Figure 20:
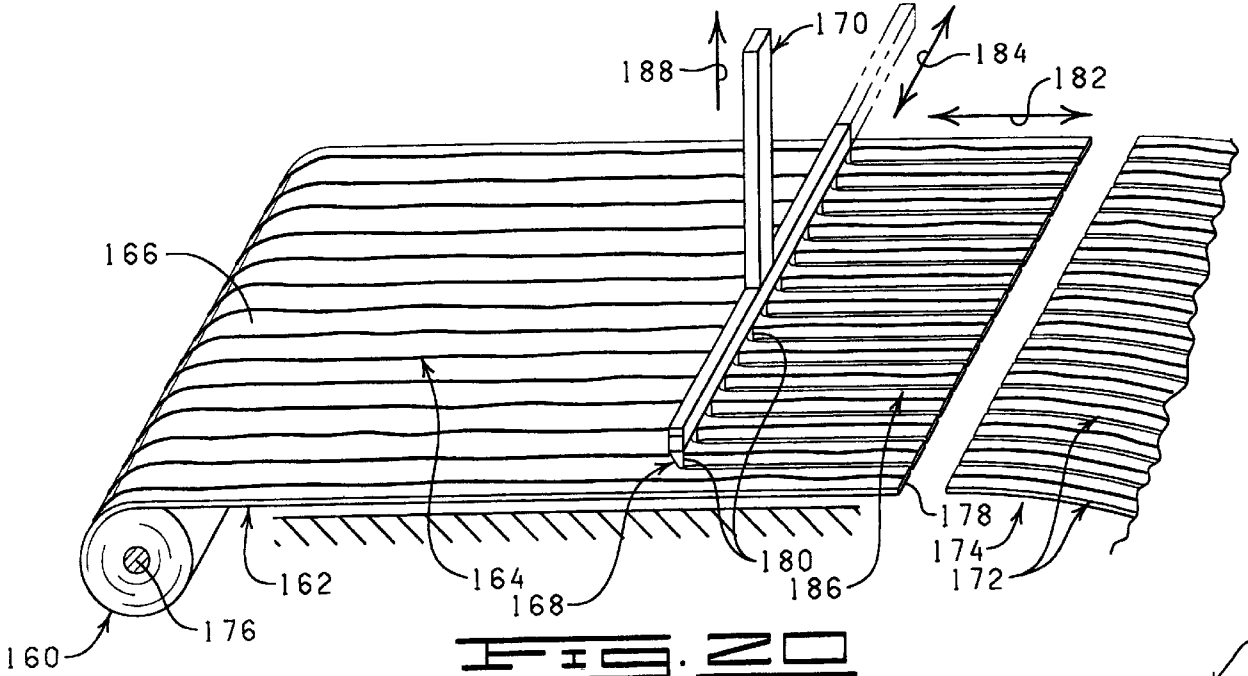
FIG. 20 is a perspective view of a roll of material having a three-dimensional pattern disposed thereon and illustrating a knife edge being actuated by an actuator to cut at least a portion of the roll of material into elongated segments of decorative grass.

Referring now to FIG. 20, a roll 160 of material 162 having a three-dimensional pattern 164 provided on at least one surface of thereof, such as an upper surface 166 of the material 162, is illustrated, together with a knife assembly 168 which is actuated by an actuator 170 to cut at least a portion of the material 162 withdrawn from the roll 160 into elongated segments 172 of decorative grass 174. The material 162 is substantially identical in construction as the sheet of material 10 having a three-dimensional pattern 28 provided on at least a portion of one of the surfaces of the sheet of material 10 as hereinbefore described with reference to FIG. 1. That is, the material 162 can be made of paper (untreated or treated in any manner), cellophane, metal foil, polymer film, non-polymer film, fabric (woven or nonwoven or synthetic or natural), cardboard, burlap, or laminations or combinations thereof. The material 162 may vary in color. Further, the material 162 may comprise other decorative patterns or designs in addition to the three-dimensional pattern 164 which are printed, etched, and/or embossed thereon. In addition, the material 162 may have various colorings, coatings, flocking and/or metallic finishes, applied separately or simultaneously, or may be characterized totally or partially by pearlescent, opaque, translucent, transparent, tinted, iridescent or the like, qualities. Each of the above-named characteristics may occur alone or in combination. Moreover, each surface of the material 162 may vary in the combination of such characteristics.

Referring now to FIG. 20, a roll 160 of material 162 having a three-dimensional pattern 164 provided on at least one surface of thereof, such as an upper surface 166 of the material 162, is illustrated, together with a knife assembly 168 which is actuated by an actuator 170 to cut at least a portion of the material 162 withdrawn from the roll 160 into elongated segments 172 of decorative grass 174. The material 162 is substantially identical in construction to the sheet of material 10 having a three-dimensional pattern 28 provided on at least a portion of one of the surfaces thereof as herein before described with reference to FIG. 1. That is, the material 162 can be made of paper (untreated or treated in any manner), cellophane, metal foil, polymer film, non-polymer film, fabric (woven or nonwoven or synthetic or natural), cardboard, burlap, or laminations or combinations thereof. The material 162 may vary in color. Further, the material 162 may comprise other decorative patterns or designs in addition to the three-dimensional pattern 164 which are printed, etched, and/or embossed thereon. In addition, the material 162 may have various colorings, coatings, flocking and/or metallic finishes, applied separately or simultaneously, or may be characterized totally or partially by pearlescent, opaque, translucent, transparent, tinted, iridescent or the like, qualities. Each of the above-named characteristics may occur alone or in combination. Moreover, each surface of the material 162 may vary in the combination of such characteristics.

The three-dimensional pattern 164 provided on the material 162 may be of any geometrical shape or design which will enhance the aesthetic qualities of a decorative grass 174 formed from the material 162, or if desired, from the sheet of material 10. That is, the three-dimensional pattern 164 provided on the material 162 may be a lace pattern, curlicues, paisleys, swirls, squiggles, and any shape generally associated with botanical items such as leaves, petals, stems, roots, fruits and any other biomorphic shapes. Further, the three-dimensional pattern 164 may be produced by printing and/or embossing the material 162, by etching at least a portion of one surface of the material 162 or by any other method known in the art.

The roll 160 of material 162 is supported on a mounted shaft 176. The material 162 having the three-dimensional pattern 164 provided thereon is withdrawn from the roll 160 of material 162 via a leading edge 178 until a predetermined length of the material 162 has been withdrawn from the roll 160 of material 162. In this position, a portion of the material 162 is disposed under the knife assembly 168 having a plurality of cutting elements 180. The knife assembly 168 is connected to the actuator 170 which is adapted to move the knife assembly 168 in a first direction 182 or in a second direction 184. When the predetermined length of the material 162 has been withdrawn from the roll 160 of the material 162, the actuator 170 moves the knife assembly 168 in the first direction 182 to a position wherein the cutting elements 180 of the knife assembly 168 severingly engage the material 162 to provide a slit web of material 186.

Figure 21:
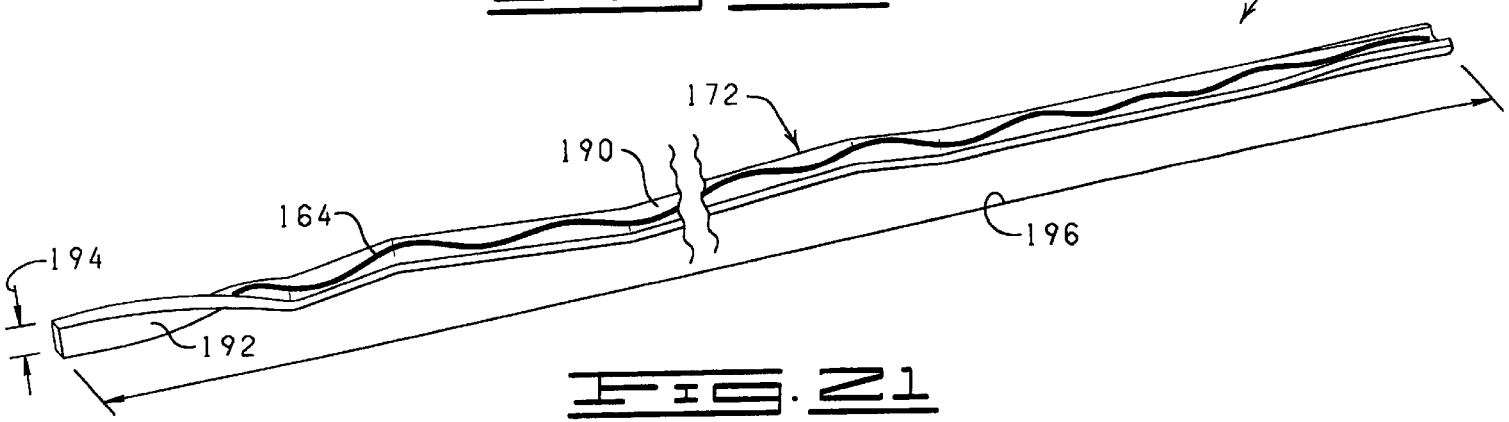
FIG. 21 is an enlarged, fragmental perspective view of one segment of decorative grass having a three-dimensional pattern disposed thereon.

In another optional mode, the actuator 170 may rotate the knife assembly 168 to the second direction 184 wherein the cutting elements 180 of the knife assembly 168 severingly re-engages the slit web of material 186 thereby causing the slit web of material 186 to be severed into the elongated segments 172 of the decorative grass 174 (FIGS. 20 and 21). The actuator 170 may comprise a hydraulic or pneumatic cylinder or a motor and gear arrangement or any other form of arrangement suitable for moving the knife assembly 168 in the first direction 182 and, when desired, in the second direction 184. After the cutting elements 180 of the knife assembly 168 have cuttingly severed the desired portion of the material 162, the actuator 170 is actuated to move the knife assembly 168 in a storage direction 188 to a storage position disposed a distance above the material 162 as opposed to the cutting positions previously described. Alternatively, the leading edge 178 of the sheet of material 162 may be run across a first knife edge (not shown) set in a support surface (also not shown) to form the slit web of material 186 wherein the actuator 170 actuates a second knife edge (not shown) to cross-cut the slit web of material 186 into elongated segments 172 of decorative grass 174. Apparatus and methods for making decorative grass and the like is disclosed in U.S. Pat. No. 4,646,388, entitled, "Apparatus For Producing Weighed Charges Of Loosely Aggregated Filamentary Material", issued to Weder et al. on Mar. 3, 1987, which is hereby expressly incorporated by reference herein.

In another optional mode, the actuator 170 may rotate the knife assembly 168 to the second direction 184 wherein the cutting elements 180 of the knife assembly 168 severingly re-engages the slit web of material 186, thereby causing the slit web of material 186 to be severed into the elongated segments 172 of the decorative grass 174 (FIGS. 20 and 21). The actuator 170 may comprise a hydraulic or pneumatic cylinder or a motor and gear arrangement or any other form of arrangement suitable for moving the knife assembly 168 in the first direction 182 and, when desired, in the second direction 184. After the cutting elements 180 of the knife assembly 168 have cuttingly severed the desired portion of the material 162, the actuator 170 is actuated to move the knife assembly 168 in a storage direction 188 to a storage position disposed a distance above the material 162 as opposed to the cutting positions previously described. Alternatively, the leading edge 178 of the sheet of material 162 may be run across a first knife edge (not shown) set in a support surface (also not shown) to form the slit web of material 186 wherein the actuator 170 actuates a second knife edge (not shown) to cross-cut the slit web of material 186 into elongated segments 172 of decorative grass 174. Apparatus and methods for making decorative grass and the like is disclosed in U.S. Pat. No. 4,646,388, entitled, "Apparatus For Producing Weighed Charges Of Loosely Aggregated Filamentary Material", issued to Weder et al. on Mar. 3, 1987, which is hereby expressly incorporated by reference herein.

The elongated segment 172 of the decorative grass 174 has a width 194 and a length 196 which define the boundaries of the elongated segment 172. The three-dimensional pattern 164 may be confined within the boundaries of the elongated segment 172 of the decorative grass 174 (substantially as shown in FIG. 20); or the three-dimensional pattern 164 may be randomly positioned on the elongated segment 172 so that only a portion of the three-dimensional pattern 164 lies within the boundaries of the elongated segment 172 of the decorative grass 174. The width 194 and length 196 of the elongated segment 172 are determined by the design and operational parameters of the knife assembly 168. Further, the width 194 and length 196, as well as the thickness of the elongated segment 172 can vary widely and will generally be dependent on the requirements of individual consumers. For most uses, however, such as when the elongated segments, such as segment 172, are used as a packing material or a decorative grass for use in filling Easter baskets, candy boxes, preparing floral arrangements, wreaths and other decorative purposes, the elongated segments will have a width of from about 0.020 inches to about 0.125 inches, a length of from about 2 inches through 24 inches and a thickness from about 0.0005 inches to about 0.0030 inches. Further, in many instances the elongated segments are intertwined into a cohesive mass whereby the elongated segments are provided with flat portions, random longitudinal curls, random transverse curls, crimped or crinkled portions and combinations thereof.

The elongated segment 172 of the decorative grass 174 has a width 194 and a length 196 which define the boundaries of the elongated segment 172. The three-dimensional pattern 164 may be confined within the boundaries of the elongated segment 172 of the decorative grass 174 (substantially as shown in FIG. 21); or the three-dimensional pattern 164 may be randomly positioned on the elongated segment 172 50 that only a portion of the three-dimensional pattern 164 lies within the boundaries of the elongated segment 172 of the decorative grass 174. The width 194 and length 196 of the elongated segment 172 are determined by the design and operational parameters of the knife assembly 168. Further, the width 194 and length 196, as well as the thickness of the elongated segment 172, can vary widely and will generally be dependent on the requirements of individual consumers. For most uses, however, such as when the elongated segments, such as segment 172, are used as a packing material or a decorative grass for use in filling Easter baskets, candy boxes, preparing floral arrangements, wreaths and other decorative purposes, the elongated segments will have a width 194 of from about 0.020 inches to about 0.125 inches, a length 196 of from about 2 inches to about 24 inches and a thickness from about 0.0005 inches to about 0.0030 inches. Further, in many instances the elongated segments 172 are intertwined into a cohesive mass whereby the elongated segments are provided with flat portions, random longitudinal curls, random transverse curls, crimped or crinkled portions and combinations thereof.

The segments of the decorative grass 174, such as the segment 172, can be produced clear or in almost any color required, and the colors can be transparent or opaque including but not exclusively red, green, yellow, pink, orchid and blue. Further, the upper and lower surfaces 190 and 192 of the elongated segment 172 may be of the same color, or of different colors, or have various coatings, flockings, and/or metallic finishes applied thereto.

As previously stated with reference to the elongated segment 172, the width 194*a* and length 196*a* of the elongated segment 172*a* are determined by the design and operational parameters of the knife assembly 168. Further, the width 194*a* and length 196*a*, as well as the thickness of the elongated segment 172*a* can vary widely and will generally be dependent on the requirements of individual consumers. For most uses, however, the elongated segment 172*a* will have a width of from about 0.020 inches to about 0.125 inches, a length of from about 2 inches through 24 inches and a thickness from about 0.0005 inches to about 0.0030 inches.

As previously stated with reference to the elongated segment 172, the width 194*a* and length 196*a* of the elongated segment 172*a* are determined by the design and operational parameters of the knife assembly 168. Further, the width 194*a* and length 196*a*, as well as the thickness, of the elongated segment 172*a* can vary widely and will generally be dependent on the requirements of individual consumers. For most uses, however, the elongated segment 172*a* will have a width 194*a* of from about 0.020 inches to about 0.125 inches, a length 196*a* of from about 2 inches to about 24 inches, and a thickness from about 0.0005 inches to about 0.0030 inches.

The segments of the decorative grass 174*a*, such as the segment 172*a*, can be produced clear or in almost any color required, and the colors can be transparent or opaque including but not exclusively red, green, yellow, pink, orchid and blue. Further, the upper and lower surfaces 190*a* and 192*a* of the segment 172*a* may be of the same color, or of different colors, or have various coatings, flockings, and/or metallic finishes applied thereto.

Figure 23:
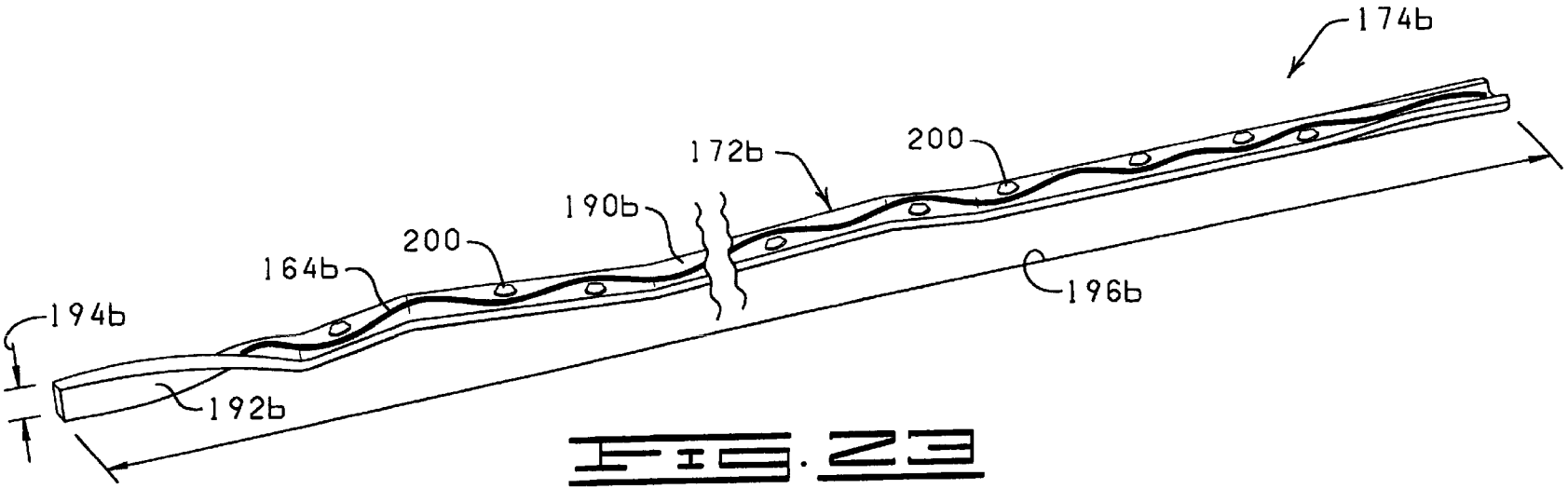
FIG. 23 is an enlarged, fragmental perspective view of one segment of decorative grass having embossed material thereon in addition to the three-dimensional pattern disposed thereon.
Figure 4:
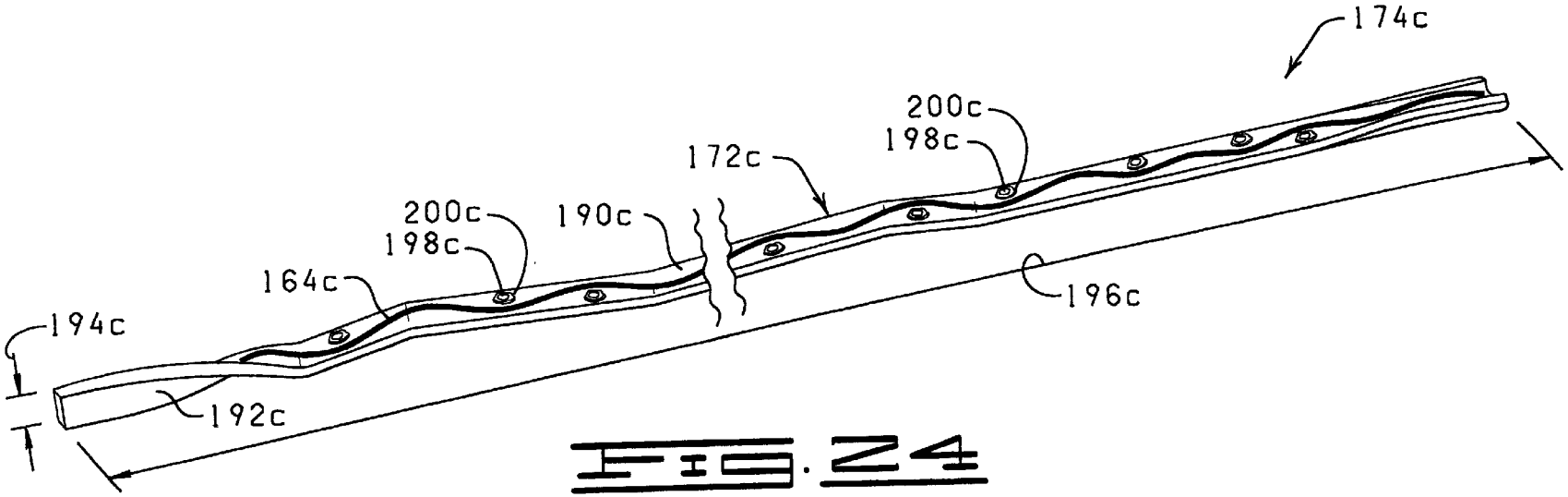
Figure 5:
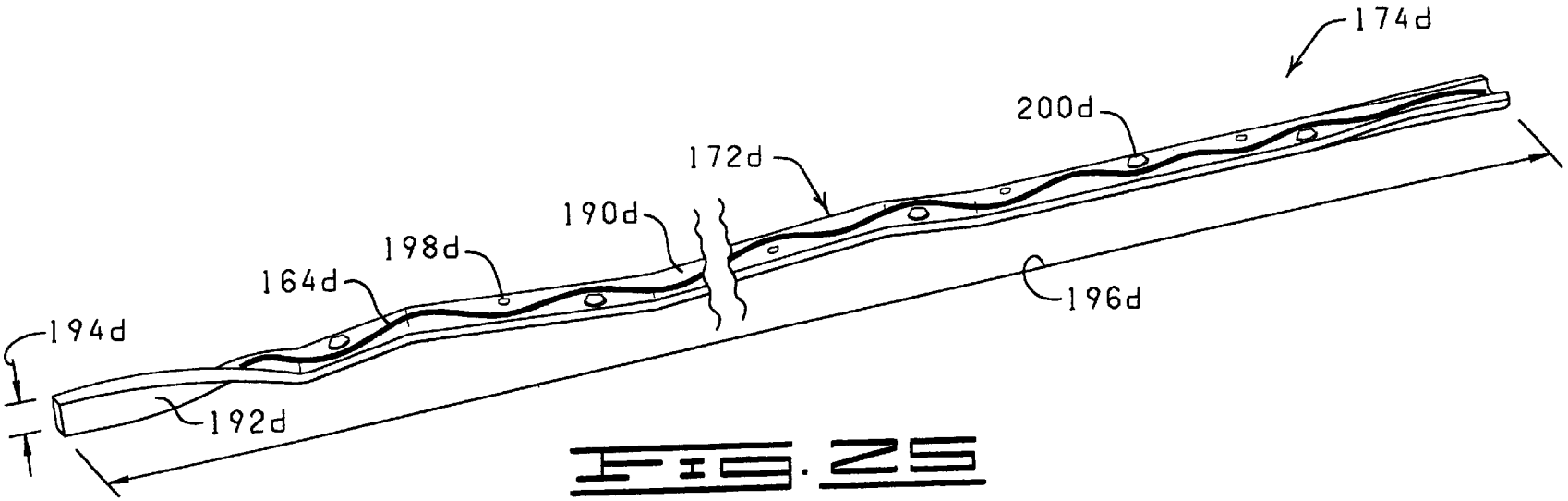

Referring now to FIG. 23, another embodiment of an elongated segment 172*b* of a decorative grass 174*b* is illustrated. The elongated segment 172*b* of the decorative grass 174*b* is provided with an upper surface 190*b* and a lower surface 192*b*. The upper surface 192*b* is provided with a three-dimensional pattern 164*b* and embossed material 200, such as a design, slogan etc., thereon. The elongated segment 172*b* has a width 194*b* and a length 196*b* which define the boundaries of the elongated segment 172*b*. The three-dimensional pattern 164*b* and the embossed material 200 may be confined within the boundaries of the elongated segment 172*b* of the decorative grass 174*b* (substantially as shown in FIG. 23); or the three-dimensional pattern 164*b* and/or the embossed material 200 may be randomly positioned on the elongated segment 172*b* so that only a portion of the three-dimensional pattern 164*b* or a portion of the embossed material 200 lie within the boundaries of the elongated segment 172*b* of the decorative grass 174*b*.

As previously stated with reference to the elongated segments 172 and 172*a*, the width 194*b* and length 196*b* of the elongated segment 172*b* are determined by the design and operational parameters of the knife assembly 168. Further, the width 194*b* and length 196*b*, as well as the thickness of the elongated segment 172*b* can vary widely and will generally be dependent on the requirements of individual consumers. For most uses, however, the elongated segment 172*b* will have a width 194*b* of from about 0.020 inches to about 0.125 inches, a length 196*b* of from about 2 inches to about 24 inches and a thickness from about 0.0005 inches to about 0.0030 inches.

The segments of the decorative grass 174*b*, such as the segment 172*b*, can be produced clear or in almost any color required, and the colors can be transparent or opaque including but not exclusively red, green, yellow, pink, orchid and blue. Further, the upper and lower surfaces 190*b* and 192*b* of the segment 172*b* may be of the same color, or of different colors, or have various coatings, flockings, and/or metallic finishes applied thereto.

As previously stated with reference to the elongated segments 172, 172*a* and 172*b*, the width 194*c* and length 196*c* of the elongated segment 172*c* are determined by the design and operational parameters of the knife assembly 168. Further, the width 194*c* and length 196*c*, as well as the thickness of the elongated segment 172*c* can vary widely and will generally be dependent on the requirements of individual consumers. For most uses, however, the elongated segment 172*c* will have a width of from about 0.020 inches to about 0.125 inches, a length of from about 2 inches through 24 inches and a thickness from about 0.0005 inches to about 0.0030 inches.

As previously stated with reference to the elongated segments 172, 172*a* and 172*b*, the width 194*c* and length 196*c* of the elongated segment 172*c* are determined by the design and operational parameters of the knife assembly 168. Further, the width 194*c* and length 196*c*, as well as the thickness of the elongated segment 172*c* can vary widely and will generally be dependent on the requirements of individual consumers. For most uses, however, the elongated segment 172*c* will have a width 194*c* of from about 0.020 inches to about 0.125 inches, a length 196*c* of from about 2 inches to about 24 inches and a thickness from about 0.0005 inches to about 0.0030 inches.

The segments of the decorative grass 174*c*, such as the segment 172*c*, can be produced clear or in almost any color required and the colors can be transparent or opaque including but not exclusively red, green, yellow, pink, orchid and blue. Further, the upper and lower surfaces 190*c* and 192*c* of the segment 172*c* may be of the same color, or of different colors, or have various coatings, flockings, and/or metallic finishes applied thereto.

Referring now to FIG. 25, another embodiment of an elongated segment 172*d* of a decorative grass 174*d* is illustrated. The elongated segment 172*d* of the decorative grass 174*d* is provided with an upper surface 190*d* and lower surface 192*d*. The upper surface 190*d* is provided with a three-dimensional pattern 164*d*, printed design and/or printed materials 198*d* and embossed material 200*d*, such as a design, slogan etc., thereon. The elongated segment 172*d* has a width 194*d* and a length 196*d* which define the boundaries of the elongated segment 172*d*. The three-dimensional pattern 164*d*, the printed design and/or printed material 198*d* and the embossed material 200*d* may be confined within the boundaries of the elongated segment 172*d* of the decorative grass 174*d* (substantially as shown in FIG. 25); or the three-dimensional pattern 164*d*, the printed design and/or printed material 198*d* and/or the embossed material 200*d* may be randomly positioned on the elongated segment 172*d* so that only a portion of the three-dimensional pattern 164*d*, and/or the printed design and/or printed material 198*d*, and/or the embossed material 200*d*, lie within the boundaries of the elongated segment 172*d* of the decorative grass 174*d*. In the embodiment shown in FIG. 25, the printed design and/or printed material 198*d* and the embossed material 200*d* are out or register with one another.

It should be noted that while the three-dimensional pattern 164–164*d*, the printed design and/or printed material 198, 198*c* and 198*d*, and/or the embossed material 200, 200*c* and 200*d* have been illustrated on the upper surfaces 190–190*d* of the segments 172–172*d* of the decorative grass 174–174*d*, the three-dimensional pattern 164–164*d*, the printed design and/or printed material 198, 198*c* and 198*d* and the embossed material 200, 200*c* and 200*d* can be provided on the lower surfaces 192–192*d* of the segments 172–172*d* of the decorative grass 174–174*d*, or on both the upper surfaces 190–190*d* of the segments 172–172*d* and the lower surfaces 192–192*d* of the segments 172–172*d*.

Further, as previously stated with reference to the elongated segments 160, 160*a*, 160*b* and 160*c*, the width 194*d* and length 196*d* of the elongated segment 172*d* are determined by the design and operational parameters of the knife assembly 168. Further, the width 194*d* and length 196*d*, as well as the thickness, of the elongated segment 172*d* can vary widely and will generally be dependent on the requirements of individual consumers. For most uses, however, the elongated segment 172*d* will have a width 194*d* of from about 0.020 inches to about 0.125 inches, a length 196*d* of from about 2 inches to about 24 inches and a thickness from about 0.0005 inches to about 0.0030 inches.

The segments of the decorative grass 174*d*, such as the segment 172*d*, can be produced clear or in almost any color required, and the colors can be transparent or opaque including but not exclusively red, green, yellow, pink, orchid and blue. Further, the upper and lower surfaces 190*d* and 192*d* of the segment 172*d* may be of the same color, or of different colors.

What is claimed:

1. A decorative grass for use in filling Easter baskets, and candy boxes, preparing floral arrangements and wreaths and other decorative purposes, the decorative grass having a three-dimensional printed pattern on a portion of at least one surface thereof, the decorative grass comprising:

a plurality of randomly arranged elongated segments, the elongated segments having a substantially planar cross-section and a three-dimensional printed pattern on a portion of one surface thereof, the plurality of elongated segments formed from a sheet of material having a three-dimensional printed pattern provided by application of a foamable ink to a portion of at least one surface thereof so that the elongated segments are provided with the three-dimensional printed pattern on a portion of at least one surface thereof, wherein the plurality of elongated segments having the three-dimensional printed pattern thereon are further intertwined into a cohesive mass whereby the elongated segments are provided with random longitudinal curls, random transverse curls and combinations thereof in addition to the three-dimensional printed pattern to thereby provide a decorative grass.

2. The decorative grass of claim 1 wherein a portion of the elongated segments are further provided with printed designs or materials on at least one surface thereof in addition to the three-dimensional printed pattern.

3. The decorative grass of claim 2 Wherein a portion of the elongated segments are further provided with an embossed material on at least one surface thereof.

4. The decorative grass of claim 3 wherein a portion of the printed designs or materials and the embossed material on the elongated segments are in registry with one another.

5. The decorative grass of claim 3 wherein a portion of the printed designs or materials and the embossed material on the elongated segments are out of registry with one another.

6. The decorative grass of claim 1 wherein a portion of the elongated segments are further provided with embossed material thereon in addition to the three-dimensional pattern.

7. A packing material having a three-dimensional pattern printed with foamable ink on a portion of at least one of an upper surface or a lower surface thereof comprising:

a plurality of elongated segments having a substantially planar cross-section, a width, a length, and an upper surface and a lower A surface wherein a portion of the elongated segments has a first three-dimensional pattern printed with a first foamable ink disposed on a portion of at least one of the upper or lower surfaces thereof and a second three-dimensional pattern printed with a second foamable ink disposed on a portion of at least one of the upper or lower surfaces thereof, and wherein the elongated segments are cut perpendicular to the width of the elongated segment to provide a packing material having a three dimensional printed pattern thereon.

8. The packing material of claim 7 wherein the first foamable ink is of a first color and the second foamable ink is of a second color which is different from the first color.

9. The packing aria claim 7 wherein a portion of the elongated segments are further provided with printed designs or materials in addition to the first three-dimensional pattern and the second three-dimensional pattern.

10. The packing material of claim 9 wherein a portion of the elongated segments are further provided with an embossed material in addition to the first three-dimensional pattern and the second three-dimensional pattern.

11. The packing material of claim 10 wherein a portion of the printed designs and materials and the embossed materials on the elongated segments are in registry with one another.

12. The packing material of claim 10 wherein a portion of the printed designs and materials and the embossed materials on the elongated segments are out of registry with one another.

13. The packing material of claim 7 wherein a portion of the elongated segments are further provided with an embossed material thereon.

* * * * *

UNITED STATES PATENT AND TRADEMARK OFFICE

CERTIFICATE OF CORRECTION

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 6,
Line 25, delete the paragraph beginning with "A plurality of sheets of ...".
Line 55, delete the paragraph beginning with "FIGS. 3-6 illustrate the ...".
Line 66, after line 65 and before line 66, add the following paragraph:
-- The foamable ink compositions may be applied to the sheet of material 10 in any conventional manner. The method of application may be manual or mechanical. If the sheets of material are in the form of a roll, then gravure, flexographic procedures, or Mayer rod procedures may be used to apply the foamable ink composition to the sheet of material 10. --.

Column 7,
Line 11, after line 10 and before line 11, add the following paragraph:
-- The bonding material 27, if present, may have a backing or release strip (not shown). The backing or release strip may be left applied for a period of time to the bonding material 27 after it is disposed on a surface of the sheet of material 10 prior to its use as a wrapping material, to protect the bonding qualities of the bonding strip. In operation, an operator may dispose the sheet of material 10 on a support surface (not shown); the lower surface 16 of the sheet of material 10 contacting the support surface. --.
Line 11, delete the paragraph beginning with words "Referring more ...".

Figure 7:
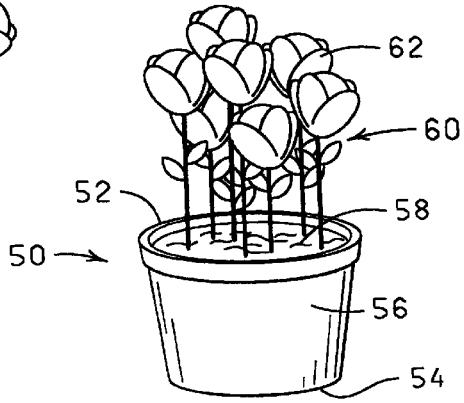
FIG. 7 is a perspective view of a flower pot containing a potted plant.

Column 8,
Line 13, after line 12 and before line 13, add the following paragraph:
"In another version of the invention, the sheet of material 10 may be used to wrap a flower pot or pot-type container, as noted above. Shown in Fig. 7 is a flower pot designated by the reference numeral 50 and which has an open upper end 52, a bottom end 54, an outer peripheral surface 56, an inner retaining space 58 within which may be disposed a growing medium. The flower pot 50 may contain a botanical item, such as a plant 60, which has an upper portion 62 comprising blooms or foliage or both. --.
Line 13, delete paragraph beginning with words "The sheet of material 10 ...".
Line 48, after line 47 and before line 48, add the following paragraph:
-- The lower surface 16 of the sheet of material 10 is positioned on an upper surface 76 on the support platform 72 such that the sheet of material 10 is positioned over the opening 74 in the support platform 72. The flower pot 50 is positioned above the sheet of material 10 and is moved in a direction 78 into the opening 74 of the flower pot cover former and band applicator device 66. As the flower pot 50 is moved into the opening 74, the sheet of material 10 is pressed about the outer peripheral surface 56 of the flower pot 50 thereby forming the decorative cover 63 about the flower pot 50. The decorative cover 63 is then secured about the flower pot 50 by the elastic band 64. The flower pot 50 having the decorative cover 63 secured thereto is then moved in a direction 80 out of the opening 74 in the support platform 72. --.

UNITED STATES PATENT AND TRADEMARK OFFICE

CERTIFICATE OF CORRECTION

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 9,
Line 5, delete the paragraph beginning with words "The bonding material may ...".

Column 10,
Line 35, after "well" and before "in" change "know" to -- known --.

Column 11,
Line 19, after line 18 and before line 19, add the following paragraph:
-- The material from which the sleeve 86 is constructed is the same as previously described above for the sheet of material 10. Such materials used to construct the sleeve 86 are further described in U.S. Patent No. 5,111,637, which is hereby expressly incorporated herein by reference. Any thickness of material may be utilized in accordance with the present invention as long as the sleeve 86 may be formed as described herein, and as long as the formed sleeve 86 may contain at least a portion of a flower pot or a floral grouping, as described herein. Additionally, an insulating material such as bubble film, preferable as one of two or more layers, can be utilized in order to provide additional protection for the item, such as the floral grouping, contained therein. --.
Line 19, delete paragraph beginning with words "In FIG. 11 the sleeve 86 is ...".
Line 58, after line 58 and before line 59, add the following paragraph:
-- As noted above, a bonding material may be disposed on a portion of the sleeve 86 or any sleeve described herein to assist in holding the sleeve 86 to the flower pot when the flower pot is disposed within the sleeve 86 or to assist in closing the upper end 88 of the sleeve 86 or adhering the sleeve 86 to the flower pot after the flower pot has been disposed therein, as will be discussed in further detail below. --.
Line 59, delete the paragraph beginning with words "It will be understood that ...".

Column 12,
Line 44, after line 44 and before line 45, add the following paragraph:
-- Certain versions of sleeves described herein may be used in combination with a preformed pot cover. For example, a preformed pot cover may be applied to the pot, then the covered pot wrapped or disposed within a sleeve. Either the cover or the sleeve, or both, may have the three-dimensional pattern printed thereon. Examples of sleeves which may be used in this invention are shown in the specification of U.S. Patent No. 5,625,979, issued May 6, 1997, to Donald E. Weder which is expressly incorporated herein by reference in its entirety. Equipment and devices for forming sleeves are commercially available, and well known in the art. --.
Line 45, delete paragraph beginning with words "Shown in FIGS. 12 and ...".

UNITED STATES PATENT AND TRADEMARK OFFICE

CERTIFICATE OF CORRECTION

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 13,
Line 54, after line 54 and before line 55, add the following paragraph:
-- In the intact sleeve 86b, the skirt portion 122 comprises an upper peripheral edge congruent with the detaching element 112 which is connected to a lower peripheral edge, also congruent with the detaching element 112, of the upper portion 114 of the sleeve 86b. In Figs. 14 and 15, the upper peripheral edge of the skirt portion 122 is congruent with a series of alternating diagonally-oriented lines of perforations which together form a zig-zag and comprise the detaching element 112. The upper portion 114 of the sleeve 86b may also have an additional detaching element 124 indicated as a plurality of vertical perforations for facilitating removal of the upper portion 114 of the sleeve 86b and which are disposed more or less vertically therein so as to extend between the detaching element 112 of the sleeve 86b and the upper end 88b of the sleeve 86b. --.
Line 55, delete paragraph beginning with words "The upper portion 114 of ...".

Column 14,
Lines 24, after line 24 and before line 25, add the following paragraph:
-- "Detaching element" as used herein, can be any element, or combination of elements, or features, such as, but not by way of limitation, perforations, tear strips, zippers, and any other devices or elements of this nature known in the art, or any combination thereof. Therefore, while perforations are shown and described in detail herein, it will be understood that tear strips, zippers, or any other "detaching elements" known in the art, or any combination thereof, could be substituted therefor and/or used therewith. --.
Line 25, delete paragraph beginning with words "In a general method of ...".

Column 15,
Line 4, after line 3 and before line 4, add the following header:
-- Embodiments of Figs. 17-18 --.
Line 19, after line 19 and before line 20 add the following paragraph:
-- The decorative preformed flower pot cover 128 has an upper end 136, a lower end 138, and an outer peripheral surface 140. An opening 142 intersects the upper end 136, forming an inner peripheral surface 144 which defines and encompasses a retaining space within which a flower pot 146 containing a floral grouping 148 may be disposed in a manner well known in the art and which is shown in Fig. 18. --.
Line 20, delete paragraph beginning with words "The decorative preformed ...".
Line 65, after line 65 and before line 66, add the following paragraph:
-- Methods for forming such preformed decorative pot covers are well known in the art. Two methods of forming such covers are described in U.S. Patent Nos. 4,773,182 and 5,291,721, each of which is hereby expressly incorporated herein by reference. --.
Line 66, delete paragraph beginning with words "Further, in accordance ...".

UNITED STATES PATENT AND TRADEMARK OFFICE

CERTIFICATE OF CORRECTION

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 16,
Line 11, delete the paragraph beginning with words "Referring now to FIG. 20, ...".
Line 37, after line 37 and before line 38, add the following header:
-- Embodiments of Figs. 20 - 25 --.

Column 17,
Line 10, after line 10 and before line 11, add the following paragraph:
-- The three-dimensional pattern 164 may cover only a portion of the material 162 or may cover an entire surface of the material 162. Further, the three-dimensional pattern 164 may be positioned on the material 162 so that when the material 162 is cut into elongated segments 172 of decorative grass 174, the three-dimensional pattern 164 substantially uniformly lies within the boundaries of the elongated segments 172; or the three-dimensional pattern 164 may be positioned on the material 162 so that when the material 162 is cut into elongated segments 172 of decorative grass 174, the three-dimensional pattern 164 is randomly positioned on the elongated segments 172 whereby the three-dimensional pattern 164 is not uniformly provided within the boundaries of the elongated segments 172. --.
Line 27, delete paragraph beginning with words "In another optional mode ...".

Column 18,
Line 15, after line 15 and before line 16, add the following paragraph:
-- Referring now to Fig. 21, one elongated segment 172 of the decorative grass 174 is illustrated. The elongated segment 172 of the decorative grass 174, which is produced from the material 162 having the three-dimensional pattern 164, is provided with an upper surface 190 having the three-dimensional pattern 164 thereon and a lower surface 192. While the elongated segment 172 of the decorative grass 174 has been shown as having the three-dimensional pattern 164 on the upper surface 190 thereof, it should be under- stood that the elongated segment 172 of the decorative grass 174 can be provided with the three-dimensional pattern 164 on the lower surface 192 thereof, or on both the upper and lower surfaces 190 and 192. --.
Line 16, delete the paragraph beginning with words "The elongated segment ...".

UNITED STATES PATENT AND TRADEMARK OFFICE

CERTIFICATE OF CORRECTION

Figure 22:
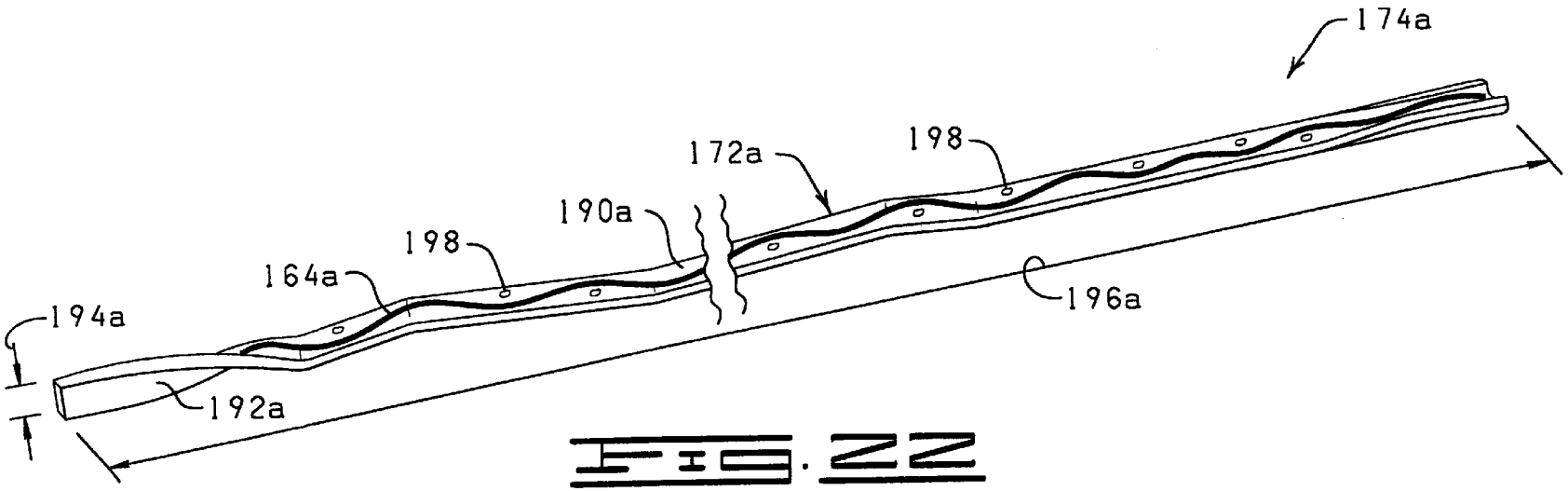
FIG. 22 is an enlarged, fragmental perspective view of one segment of decorative grass having printed material thereon in addition to the three-dimensional pattern disposed thereon.

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 19,
Line 13, after line 13 and before line 14, add the following paragraph:
-- Referring now to Fig. 22, another embodiment of an elongated segment 172a of a decorative grass 174a is illustrated. The elongated segment 172a of the decorative grass 174a is provided with an upper surface 190a and a lower surface 192a. The upper surface 190a is provided with a three-dimensional pattern 164a and a printed design and/or printed materials 198. The elongated segment 172a has a width 194a and a length 196a which define the boundaries of the elongated segment 172a. The three-dimensional pattern 164a and the printed design and/or printed materials 198 may be confined within the boundaries of the elongated segment 172a of the decorative grass 174a (substantially as shown in Fig. 22); or the three-dimensional pattern 164a and/or the printed design and/or printed materials 198 may be randomly positioned on the elongated segment 172a so that only a portion of the three-dimensional pattern 164a, the printed design and/or printed materials 198, or the three-dimensional pattern 164a and the printed design and/or printed materials 198 lay within the boundaries of the elongated segment 172a of the decorative grass 174a. --.
Line 14, delete the paragraph beginning with words “As previously stated ...”.

Column 20,
Line 17, after line 17 and before line 18, add the following paragraph:
-- Referring now to Fig. 24, another embodiment of an elongated segment 172c of a decorative grass 174c is illustrated. The elongated segment 172c of the decorative grass 174c is provided with an upper surface 190c and a lower surface 192c. The upper surface 190c is provided with a three-dimensional pattern 164c, printed design and/or printed materials 198c and embossed material 200c, such as a design, slogan etc., thereon. The elongated segment 172c has a width 194c and a length 196c which define the boundaries of the elongated segment 172c. The three-dimensional pattern 164c, the printed design and/or printed material 198c and the embossed material 200c may be confined within the boundaries of the elongated segment 172c of the decorative grass 174c (substantially as shown in Fig. 24); or the three-dimensional pattern 164c, the printed design and/or printed material 198c and/or the embossed material 200c may be randomly positioned on the elongated segment 172c so that only a portion of the three-dimensional pattern 164c, and/or the printed design and/or printed material 198c, and/ or the embossed material 200c, lie within the boundaries of the elongated segment 172c of the decorative grass 174c. However, in the embodiment shown in Fig. 24, the printed design and/or printed material 198c, and/or the embossed material 200c are in register with one another. --.

Column 20,
Line 18, delete the paragraph beginning with words “As previously stated with ...”.

UNITED STATES PATENT AND TRADEMARK OFFICE

CERTIFICATE OF CORRECTION

PATENT NO. : 6,596,352 B2
APPLICATION NO. : 10/058193
DATED : July 22, 2003
INVENTOR(S) : Donald E. Weder It is certified that error appears in the above-identified patent and that said Letters Patent is hereby corrected as shown below:

Column 21,
Line 38, after line 38 and before line 39, add the following paragraph:
-- Changes may be made in the construction and the operation of the various components, elements and assemblies described herein or in the steps or the sequence of steps of the methods described herein without departing from the spirit and scope of the invention as defined in the following claims. --.

Column 22,
Line 8, after "2" and before "a" change "Wherein" to -- wherein --.
Line 25, after "lower" and before "surface" delete "A".
Line 39, after "packing" and before "claim" change "aria" to -- material --.
Line 41, after "designs" and before "in" delete "or materials".

Signed and Sealed this

Eleventh Day of July, 2006

JON W. DUDAS
*Director of the United States Patent and Trademark Office*